United States Patent [19]

Enk et al.

[11] Patent Number: 4,482,018

[45] Date of Patent: Nov. 13, 1984

[54] FIRE PROTECTION SYSTEM FOR AIRCRAFT

[75] Inventors: William A. Enk, 1213 Horizon, Blue Springs, Mo. 64015; Ronald Migis, Jackson County, Mo.

[73] Assignee: William A. Enk, Blue Springs, Mo.

[21] Appl. No.: 324,698

[22] Filed: Nov. 25, 1981 (Under 37 CFR 1.47)

[51] Int. Cl.[3] ..... A62C 35/12

[52] U.S. Cl. ..... 169/62; 307/9

[58] Field of Search ..... 169/62, 60, 61, 54, 169/16, 5, 19, 23; 137/553, 554

[56] References Cited

U.S. PATENT DOCUMENTS

| | | | |
|---|---|---|---|
| 2,378,404 | 6/1943 | Grant | 137/554 |
| 2,399,553 | 4/1946 | Lindsay et al. | 169/16 |
| 2,435,425 | 2/1948 | Cunningham | 335/229 |
| 2,560,091 | 7/1951 | Davis | 169/62 |
| 3,100,017 | 8/1963 | Johnson | 169/17 |
| 3,174,550 | 3/1965 | Bugg | 169/44 |
| 3,227,219 | 1/1966 | Boyer et al. | 169/23 |
| 3,380,047 | 4/1965 | Lindberg | 340/747 P |
| 3,465,827 | 9/1969 | Levy et al. | 169/61 |
| 3,664,430 | 5/1972 | Sitabkhan | 169/23 |
| 3,683,239 | 8/1972 | Sturman | 361/194 |
| 3,825,766 | 7/1974 | Connor et al. | 307/9 |
| 3,865,192 | 2/1975 | Dunphy | 169/61 |
| 4,082,148 | 4/1978 | Willms | 169/61 |
| 4,195,662 | 4/1980 | Gottel | 137/554 |

FOREIGN PATENT DOCUMENTS 669373 7/1979 U.S.S.R. .

*Primary Examiner*—Joseph J. Rolla
*Assistant Examiner*—Kenneth Noland
*Attorney, Agent, or Firm*—Kokjer, Kircher, Bradley, Wharton, Bowman & Johnson

[57] ABSTRACT

An aircraft fire protection system includes a plurality of extinguishant bottles which can be detonated to deliver extinguishant into a manifold and then to selected fire zones through valves associated with the respective fire zones. Solid state control circuitry opens the appropriate valve when a corresponding push button switch is initially depressed and detonates one or more bottles in sequence when the same switch is subsequently depressed one or more times. A manual crash switch opens all valves when depressed once and discharges all bottles when depressed again. An automatic crash switch opens all valves and detonates all bottles if the aircraft should crash. A test circuit operates in a test mode to open all valves in sequence and to simulate sequential detonation of all bottles by applying low level current to the bottle detonator circuits.

29 Claims, 18 Drawing Figures

FIRE PROTECTION SYSTEM FOR AIRCRAFT

BACKGROUND OF THE INVENTION

This invention relates in general to a fire protection system used for extinguishing fires and more particularly to an improved fire protection system for aircraft.

The fire extinguishing systems that have been proposed in the past for use in airplanes and helicopters, as well as other aerospace vehicles have suffered from numerous drawbacks. Perhaps most notably, the controls and procedure for operating the system are typically complicated, and it may be difficult to operate the proper controls in the necessary sequence, especially under an emergency situation such as a fire. Another problem is that only a small part of the total extinguishant material may be available for application to any one designated fire zone. Therefore, the additional extinguishant that is present in the system cannot be applied once the designated portion is exhausted, even if the additional material is necessary to put out the fire.

A complete operational check of all components cannot be done as part of a normal preflight inspection. Although preflight testing of portions or components of some systems is possible, the testing procedure does not always assure the integrity and operability of all components of the system. Also, if the control system or any of its components malfunctions, the fact that a fault exists is not indicated until it is too late to take corrective action.

SUMMARY OF THE INVENTION

The present invention is directed to an improved aircraft fire protection system and has, as its primary object, the provision of a system which functions effectively and reliably and which is operated by simple and easily activated controls. Another important object of the invention is to provide an aircraft fire protection system having an easily operated testing arrangement for reliably testing the entirety of the control circuit and all of its components as well as the components of the extinguishing system. The fire protection system also makes the entire amount of extinguishant material available to each fire zone if necessary.

It is an objective of the invention to permit the reliable and simple control of a multiple zone fire protection system by one or more compact centrally located control panels that also display the status of the system during operation.

Conventional methods for controlling complex fire extinguishing and detection systems use pull "Tee handles" selector switches, push button switches and similar controls that require a greater amount of space than the present invention. The operator of, for instance, a complex 2-zone conventional system must identify the affected zone, pull the proper Tee handle, select the proper bottle, and then push the proper discharge switch. If a second discharge in the same zone is required he must reselect to another full bottle and then push the proper discharge switch again. If he wishes to discharge to a different zone than originally identified, he may have to first reset the controls associated with the original zone identified, by at least resetting the "pulled" Tee handle. Then he must proceed as described above for the new zone. Sometimes, these actions can be accomplished accurately under stress, but if more zones are included in a protection system exact judicious actions will be required to accurately operate the system. The conventional controls will likely be too numerous and the actions required too complex for a reliable system that actually increases the overall safety of operation of an aerospace vehicle.

In accordance with the invention, an aerospace vehicle such as an airplane or helicopter is arbitrarily divided into designated fire zones which are each connected with a supply manifold and equipped with a solenoid valve for directing extinguishant material from the manifold to the corresponding fire zone. The manifold is supplied with extinguishant material from a series of bottles each having an electrically actuated detonator. The system includes a solid state control circuit which detonates the bottles after previously opening the appropriate valve or valves to direct extinguishant to the area of the fire.

It is a particularly important feature of the invention that there is only one switch for each fire zone, and the controls are simplified accordingly. Each switch opens the corresponding valve to arm the system when pushed once, and subsequent depressions of the switch detonate the bottles in sequence under the control of logic circuitry in the control system. Thus, only one switch must be depressed to fight fire in any zone of the aircraft, and any desired amount of extinguishant material can be directed to the fire zone simply by repeatedly depressing the corresponding switch. The circuitry is arranged to assure that detonation of the bottles can occur only if there is an open valve. Also, opening of one valve effects automatic closing of any previously opened valves in order to assure that the extinguishant material is directed to the intended area.

Another important feature of the invention is that all of the bottles and valves can be opened to apply extinguishant material throughout the aircraft if a crash is imminent or occurs. This is accomplished simply by depressing a "crash" switch once to open all valves and again to detonate all bottles. An impact switch included in the control circuitry automatically achieves the same results (application of extinguishant throughout the aircraft) if a crash occurs before the pilot has an opportunity to activate the manual "crash" switch.

The system further includes a simplified and improved test circuit for preflight checking of the operability of all components. The test system is controlled by a single switch which can be moved to the test position at any time a test is desired. A series of indicator lights then automatically cycle in sequence to confirm that all valves can be opened and that all bottles can be detonated. The actual opening of each valve in sequence in the test mode is indicated by the lights, as is the fact that current paths are available through all unopened bottle detonators. The ability of the valves to actually open and the detonators to actually discharge the bottles is thereby confirmed during the test procedure without the possibility of inadvertent detonation of any bottles in the test mode. A flashing amber test light provides an additional indication that the system is in the test mode. If there is a fault in the system, the test light does not blink but is constantly on to provide a fault indication.

An additional feature of importance is the volume selector switch which permits adjustment of the quantity of extinguishant directed to any of the fire zones. For example, if the cargo area is full or nearly full, only a relatively small amount of extinguishant is required to fill the open space. Conversely, a larger amount of extinguishant is necessary if only a small amount of cargo is present. Thus, on flights having full cargo compartments, the volume selector switch can be moved to the "full cargo" position, and the control circuit discharges a relatively small amount of extinguishant (two bottles, for example) each time the cargo switch is depressed. If the cargo area is relatively empty, the volume selector switch can be placed in the "empty cargo" position in which a greater quantity of extinguishant (three bottles, for example) is discharged for each depression of the cargo switch. Such a selector switch may be associated with each zone switch.

An alternative and somewhat simplified form of the invention intended primarily for use in smaller aircraft permits the fire protection system to utilize either three way valves or two way valves, and its versatility is increased accordingly. Also, the test and crash systems are modified somewhat.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in various views.

Figure 9:
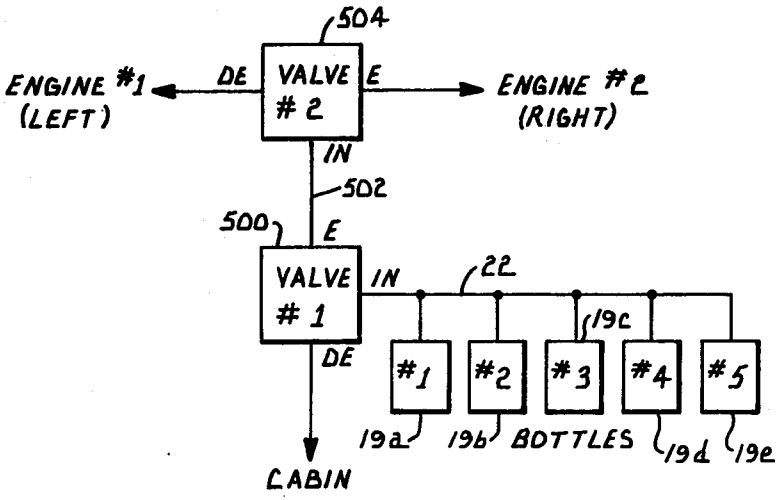
FIG. 9 is a general diagrammatic illustration of the valve arrangement of a fire protection system constructed according to an alternative form of the invention employing two three way valves for three fire zones.
Figure 10I:
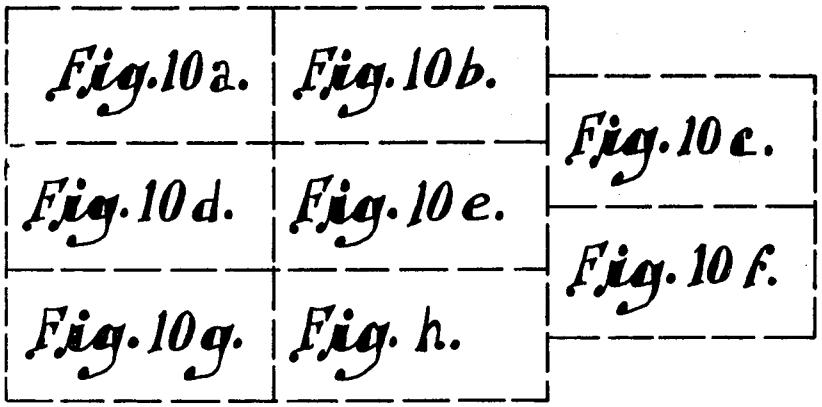

FIGS. **10*a*–10*h* are schematic circuit diagrams illustrating the control circuitry for the system of FIG. 9; and FIG. 10*i* is an organizational diagram depicting the manner in which FIGS. 10*a*–10*h*** are organized in relation to one another.

Figure 1:
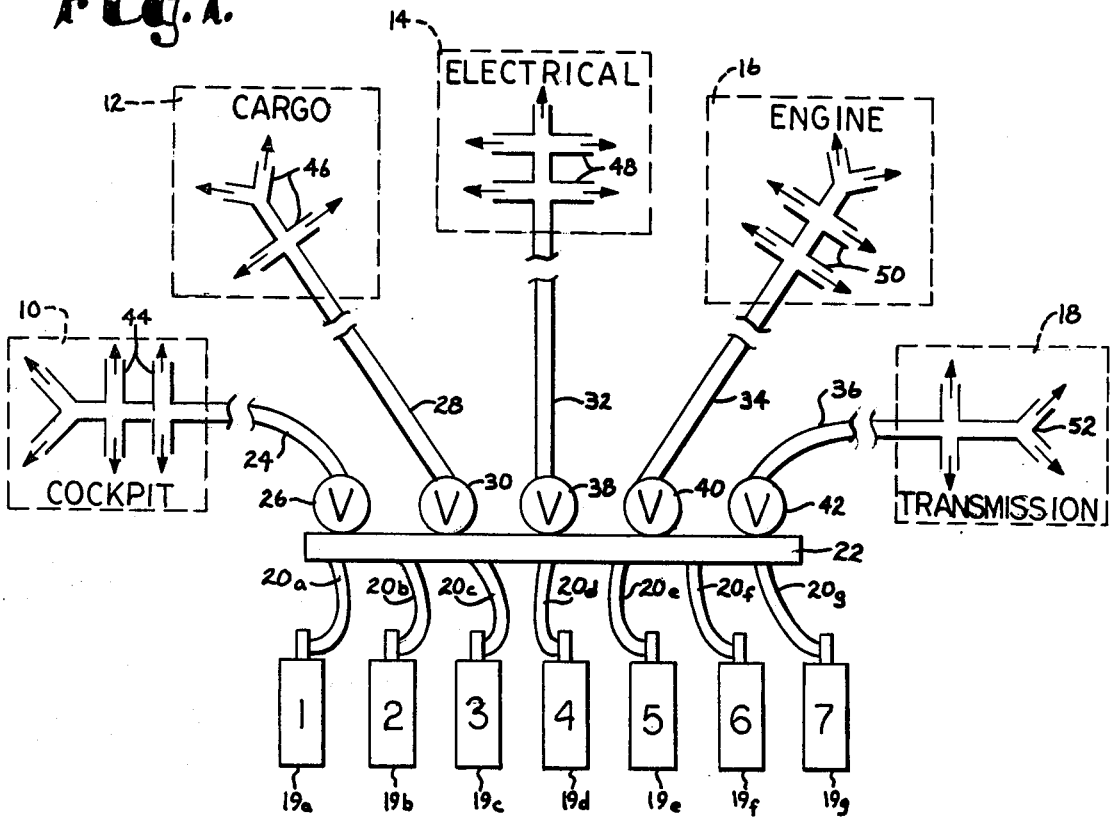
FIG. 1 is a general diagrammatic illustration of an aircraft fire protection system constructed according to a first embodiment of the present invention.

Referring now to the drawings in detail, FIGS. 1–8 illustrate an aircraft fire protection system constructed in accordance with a first embodiment of the present invention. The aircraft can be of any type, and any number of fire zones within the craft can be arbitrarily selected. FIG. 1 illustrates an aircraft having five different major fire zones, namely a cockpit 10, a cargo area 12, an electrical compartment 14, an engine compartment 16 and a transmission section 18. It is to be understood that more or fewer designated fire zones can be formed, and that the zones illustrated are given merely by way of example. Also, one or more minor fire zones can be included in a major zone.

Bottles containing a suitable fire extinguishant are provided and are illustrated as being seven in number, again an arbitrarily selected number that can be varied as desired. The extinguishant bottles 1–7 are designated by numerals **19*a*–19*g*, respectively, and each has a corresponding conduit 20*a*–20*g* leading to a manifold pipe 22 which is common to all of the bottles. A conduit 24 equipped with a conventional solenoid valve 26 extends from manifold 22 to the cockpit 10, and another conduit 28 with a solenoid valve 30 leads to the cargo area 12 from the manifold. Similarly, conduits 32,34 and 36 extend from the manifold to the electrical compartment 14, the engine compartment 16 and the transmission 18, respectively, and are provided with respective solenoid valves 38, 40 and 42**.

Conduit 24 terminates in a plurality of nozzles 44 which serve to discharge the fire extinguishant material into cockpit 10 in the event of a fire in the cockpit. Conduit 28 has a plurality of similar nozzles 46 in the cargo area, while the remaining conduits 14, 16 and 18 likewise terminate in respective sets of nozzles 48, 50 and 52 in the electrical compartment, the engine compartment and the transmission, respectively.

Figure 2:
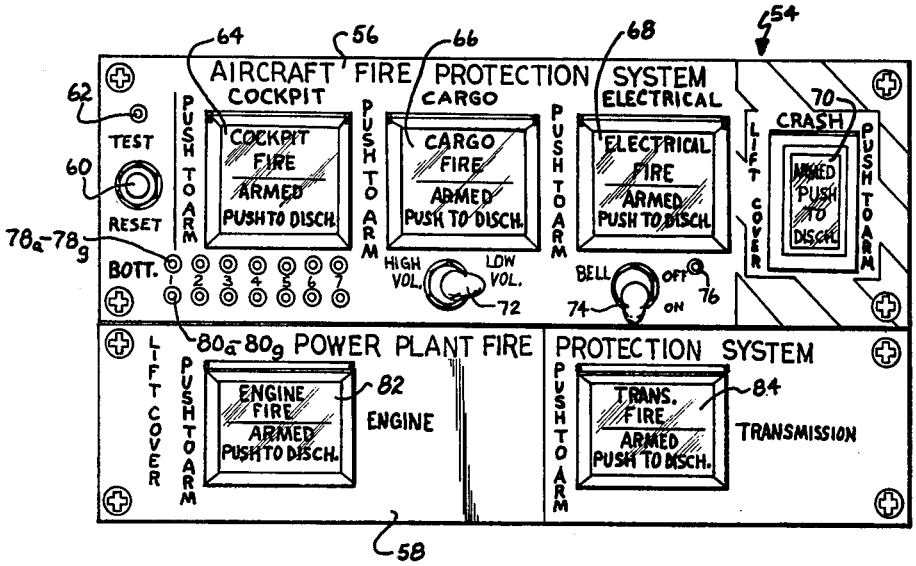
FIG. 2 is an elevational view of the control panel on which the controls of the fire protection system are mounted.

Referring now to FIG. 2, the fire protection system has a control panel which is generally indicated by numeral 54. The control panel is preferably mounted at a convenient location within the aircraft, such as on the instrument panel, where it is readily accessible to the pilot, pilots or other personnel. Control panel 54 includes a main panel 56 and an auxiliary panel 58, although the controls can be mounted on a single panel if desired. The upper main panel 56 has a test-reset toggle switch 60 which is in the "off" condition in the center position shown. Switch 60 can be moved upwardly to the "test" position or downwardly to the "reset" position, as will be described in more detail. Above the toggle switch 60 is a small light 62 formed by an LED covered by an amber colored lens.

The main control panel 56 also includes a cockpit switch 64, a cargo area switch 66 and an electrical compartment switch 68, all of which are push button switches that return to their normal extended positions after being depressed and released. A crash switch 70 located beside switch 68 is of the same type. A toggle switch 72 for controlling the volume of extinguishant material discharged into the cargo area of the aircraft is located below the cargo switch 66 and has both an empty cargo setting and a full cargo setting. A bell switch 74 located below the electrical compartment switch 68 has "off" and "on" settings. A small light 76 located beside bell switch 74 indicates the setting of the bell switch and is preferably an LED covered by an amber lens.

The main control panel has two rows of lights each having seven lights corresponding to the extinguishant bottles 1–7. The lights in the top row are designated **78*a*–78*g* and those in the bottom row are designated 80*a*–80*g*. The lights 78*a* and 80*a* correspond to bottle number 1, lights 78*b* and 80*b* correspond to bottle number 2**, and so forth. The top lights are preferably LEDs covered by green lenses, and the bottom lights are LEDs covered by amber lenses.

The auxiliary panel 58 may be located adjacent to or separated from the main panel. Panel 58 has an engine compartment switch 82 and a transmission switch 84, both of which are push button switches of the same type as switches 64–70. All of the switches on the control panel are marked appropriately, as indicated. Switches 64–70 and 82–84 preferably have covers which must be intentionally lifted to provide access to the push buttons in order to prevent inadvertent depression of any of the buttons. The lower or "ARMED" half of each switch 64–70 and 82–84 has a pair of lights which display a green color when energized, and the upper half of each switch has a pair of lights which display a red color when energized, as will be explained more fully.

Figure 3:
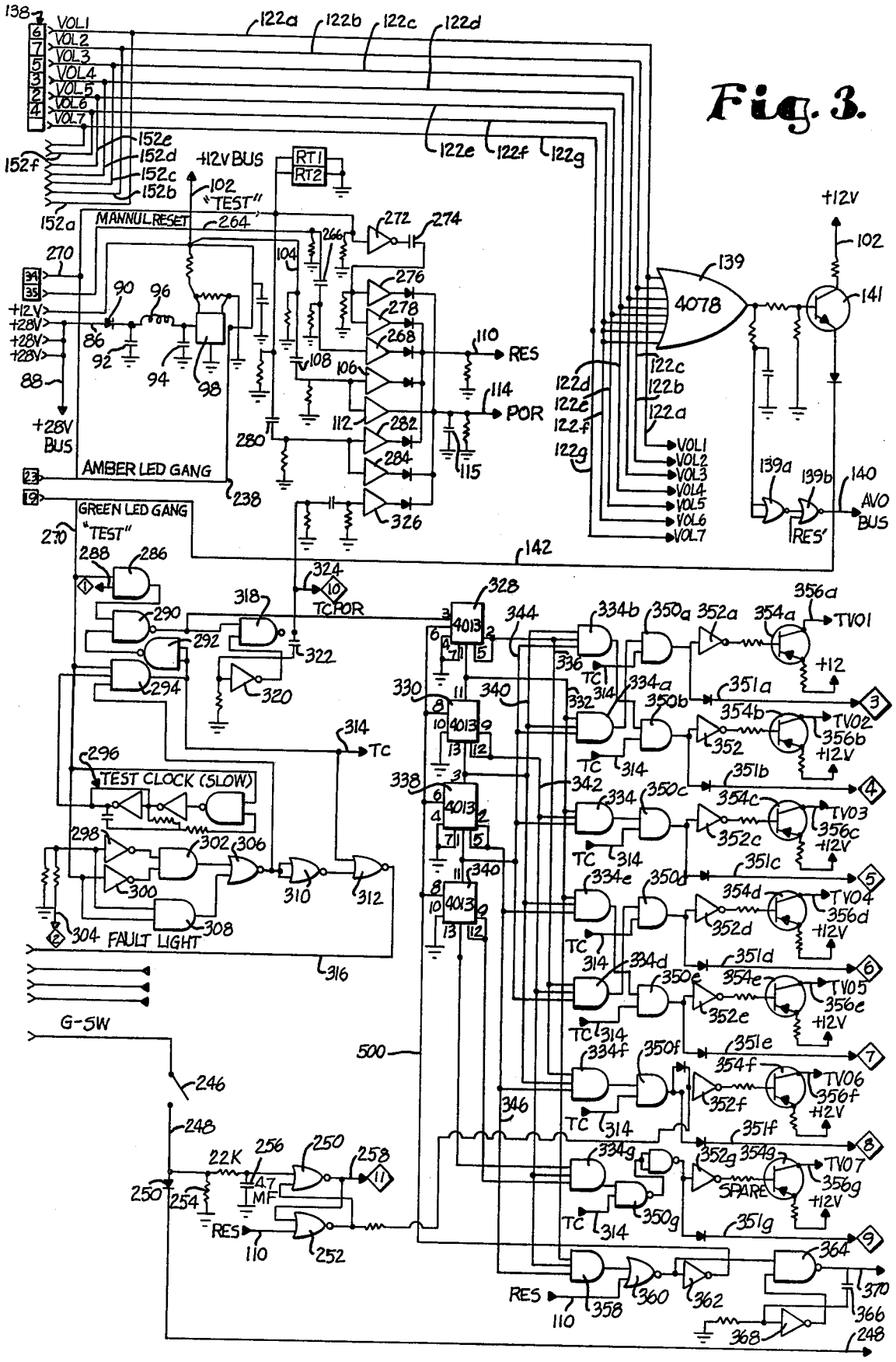
FIGS. 3–8 are schematic circuit diagrams illustrating the control circuitry which controls the operation of the fire protection system.

Turning now to the control circuit for the fire protection system, FIG. 3 illustrates a power lead 86 which supplies 28 volts from any suitable power source, such as the aircraft power system or a separate battery pack that still functions if there is a loss of electrical power in the aircraft system. The power lead 86 is connected with the power supply by a circuit breaker or the like (not shown) which is normally closed. A 28 volt power bus 88 connects with power lead 86 to provide 28 volts to various parts of the system, as will be described.

The 28 volt power lead is provided with a diode 90, a pair of filtering capacitors 92 and 94 tied to ground, and a choke coil 96. The power lead connects with a voltage regulator 98 providing approximately 12 volts on its output line 102. A 12 volt bus 102 connects with line 100 to supply various parts of the system with 12 volts. Also connecting with line 100 is another line 104 leading to an amplifier 106 through a capacitor 108. The output from amplifier 106 is applied to a reset bus 110 which applies a reset pulse when energized. Line 104 connects to another amplifier 112, the output of which is applied to a POR bus 114.

Figure 7:
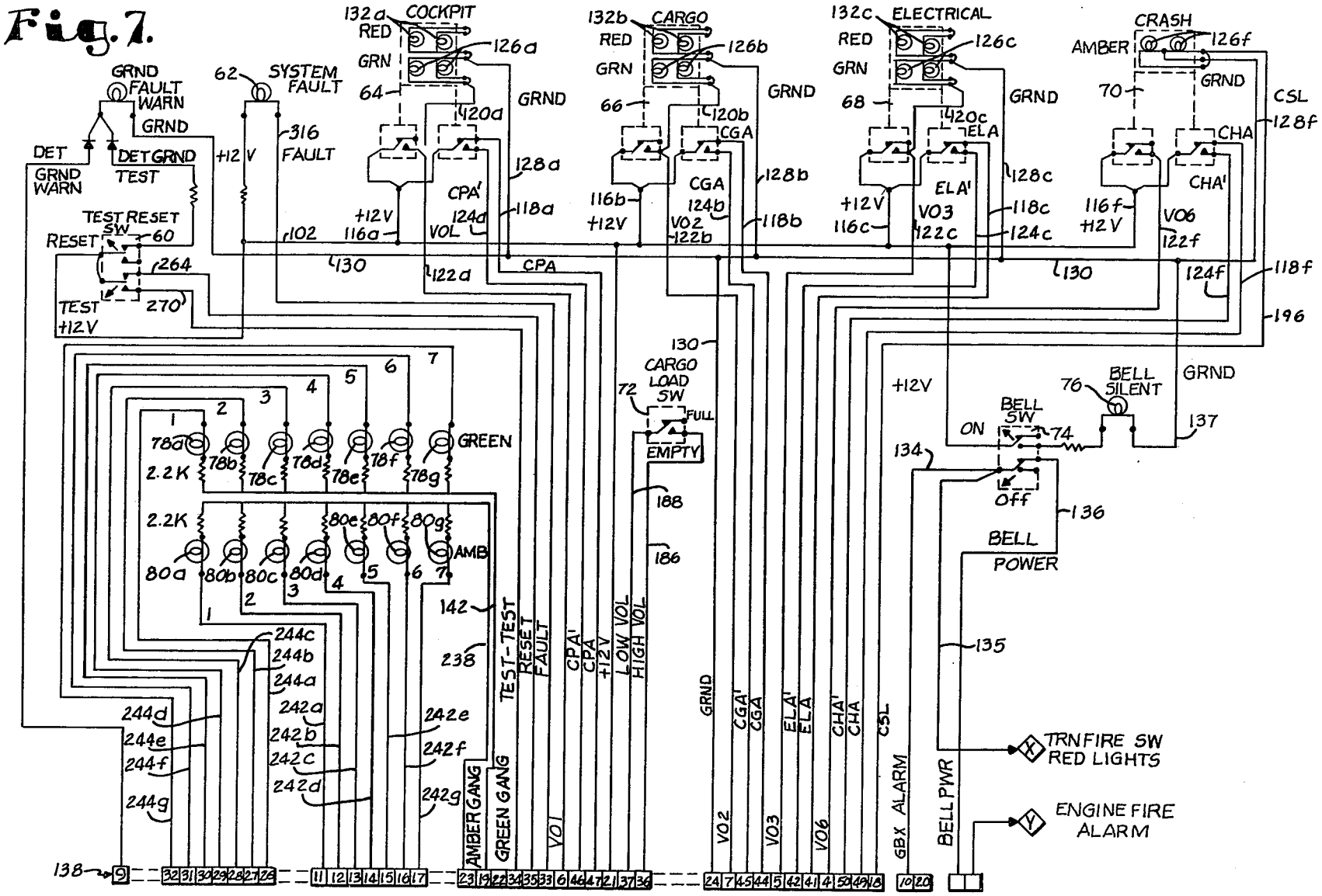
Figure 8:
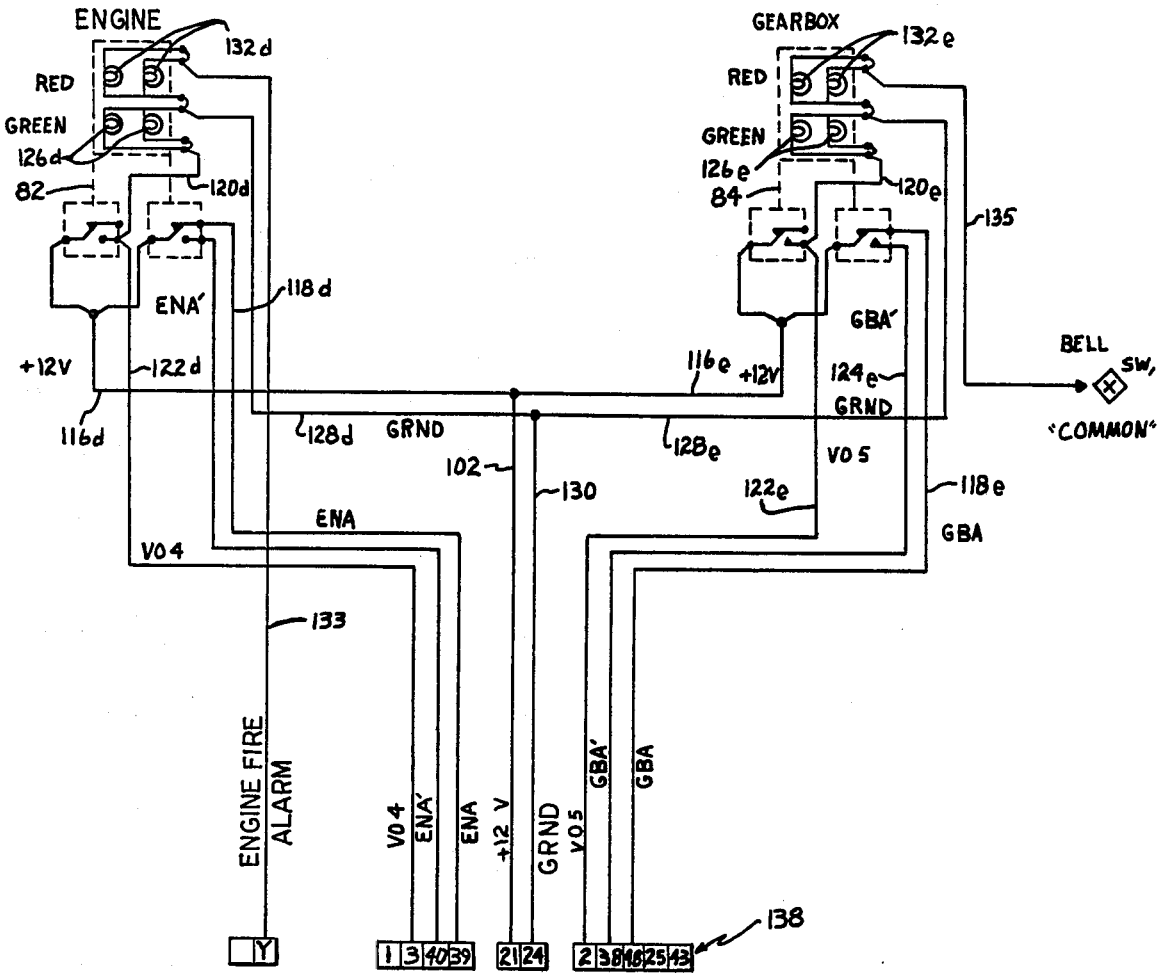
Figure 10H:
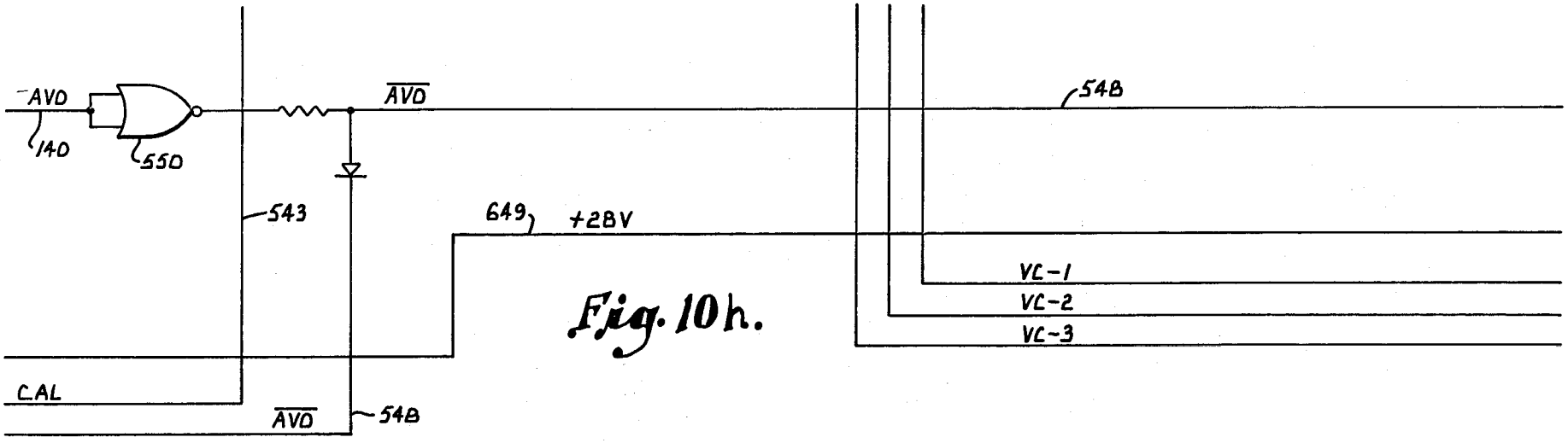

Referring now to FIGS. 7 and 8, the 12 volt power bus 102 connects with lines 116*a*, 116*b* and 116*c*, and also to lines 116*d* and 116*e* (FIG. 8). Switches 64–68 and 82–84 each have two sets of contacts, and lines 116*a*–116*e* lead to the common contacts of the respective switches. In the normal positions of the switches shown, lines 116*a*–116*e* connect only with lines 118*a*–118*e*, respectively. However, when each switch is depressed to connect its common contacts with its normally open contacts, lines 116*a*–116*e* connect respectively with lines 120*a*–120*e* through one set of contacts and with lines 122*a*–122*e* through the same set of contacts. Also, lines 116*a*–116*e* connect with lines 124*a*–124*e* through the other set of contacts.

Lines 120*a*–120*e* connect with respective pairs of green lamps 126*a*–126*e* which are arranged in parallel with one another and are located in the "ARMED" half of the respective switches 64–68 and 82–84. The opposite sides of the lamps 126*a*–126*e* connect with respective lines 128*a*–128*e* which lead to a common ground line 130. Also connected with lines 128*a*–128*e* are respective pairs of red lamps 132*a*–132*e* that may have their opposite sides tied to a conventional fire detection system (not shown) operating to light the red lamps 132*a*–132*e* in the event a fire is detected in the appropriate fire zone.

By way of example, a conventional fire detector (not shown) closes a suitable switch that applies approximately 28 volts to an engine fire alarm line 133 (FIG. 8) if a fire is detected in the engine compartment of the aircraft. The red lamps 132*d* in the upper half of switch 82 are then energized to give an "engine fire" indication to the pilot. Similarly, the detection system applies 28 volts to a gearbox alarm line 134 (FIG. 7) leading to the bell switch 74 and also to a conductor 135. As shown in FIG. 8, conductor 135 connects with the red lamps 132*e* which are then energized to indicate on the transmission switch 84 that a transmission fire has been detected.

When the bell switch 74 is in the "on" position shown in FIG. 7, its lower set of contacts connect line 134 with a bell power line 136 leading to ground through a bell (not shown) which gives an audible indication of the presence of a fire in the transmission or gearbox section of the aircraft. The upper set of contacts of the bell switch 74 open a circuit 137 extending between the 12 volt bus 102 and ground line 130. The amber bell silent light 76 is then deenergized to indicate that the audible bell signal has not been switched off. If bell switch 74 is switched to the off position, lines 134 and 136 are disconnected by the lower set of switch contacts and the bell cannot sound an alarm. At the same time, circuit 137 is completed to energize LED 76 to indicate that the bell is switched off. Ordinarily, the bell switch 74 will be switched off only after the bell has audibly indicated the detection of a transmission fire.

Lines 122*a*–122*e* are "valve open" lines VO1, VO2, VO3, VO4, and VO5, respectively. Lines 122*a*–122*c* connect through pins 6, 7 and 5 of a connector 138 with corresponding inputs to a multiple input OR gate 139 shown in FIG. 3. Lines 122*d* and 122*e* connect through pins 3 and 2 of the connector with OR gate 139. The output signal of gate 139 is applied through NOR gates 139*a* and 139*b* to an AVO (any valve open) bus 140 and is also applied to the base of a transistor 141. The 12 volt bus 102 connects through transistor 141 with a green LED gang line 142 when the transistor base receives an output signal from the OR gate 139.

Figure 4:
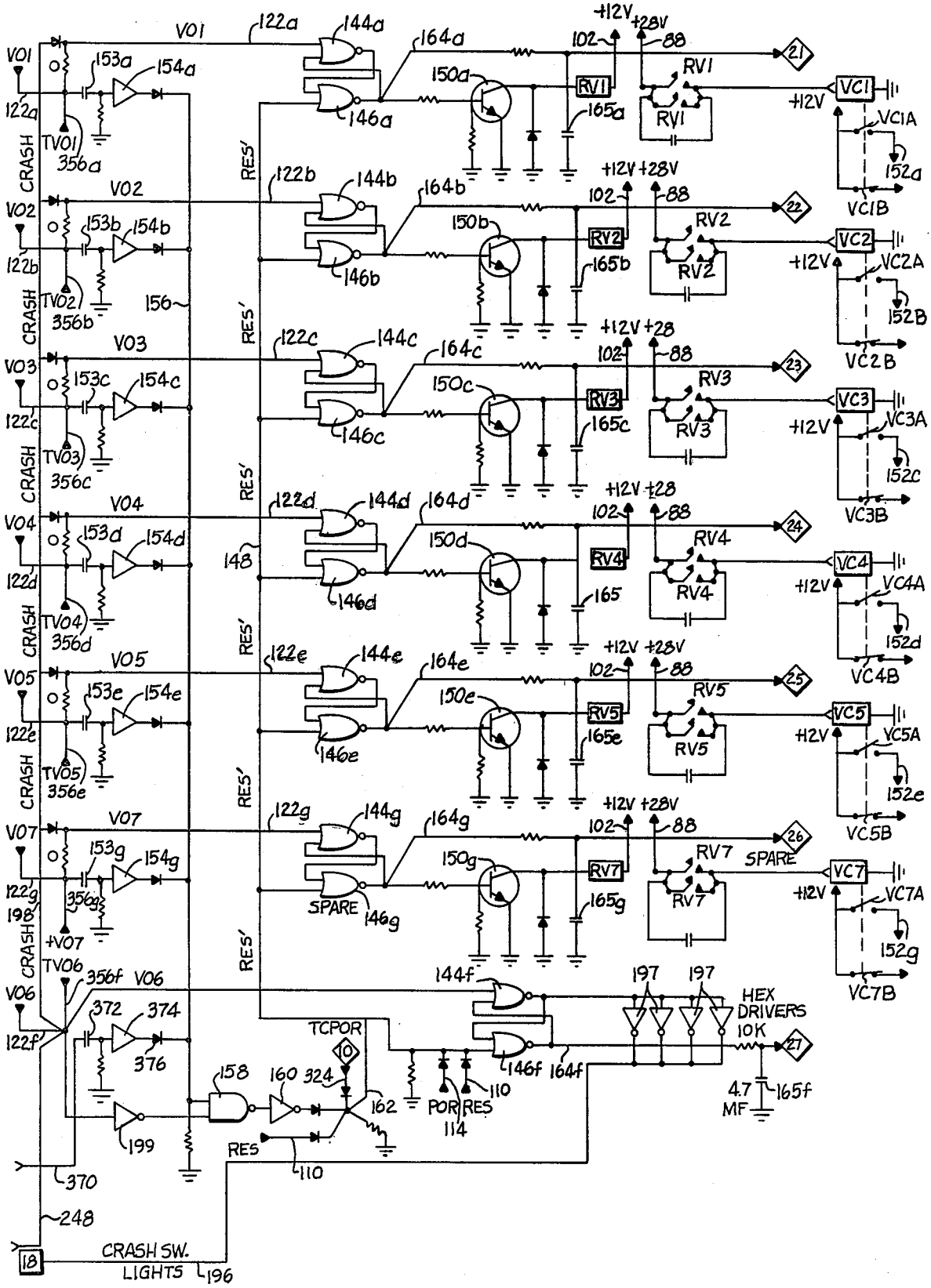

Lines 122*a*–122*e* also bypass OR gate 139 and, as shown in FIG. 4, connect with respective logic gates 144*a*–144*e* which in combination with associated gates 146*a*–146*e* form valve latch circuits for opening the valves shown in FIG. 1. The other input signal to each latch circuit is provided on a RES' bus 148 which connects with the reset (RES) bus 110 and the POR bus 114. The output signals from the valve latch circuits are applied to the bases of respective transistors 150*a*–150*e*. When the transistor bases receive high signals from the latch circuits, respective relay coils RV1, RV2, RV3, RV4 and RV5 are energized since the transistors are then conductive to provide a ground path from the 12 volt bus 102 through the relay coils.

The relay coils when energized close their respective pairs of normally open contacts RV1, RV2, RV3, RV4 and RV5 in order to complete circuits to ground from the 28 volt bus 88 through respective solenoid coils VC1, VC2, VC3, VC4 and VC5. These solenoids open the respective valves 26, 30, 38, 40 and 42 (FIG. 1) when energized to permit extinguishant to flow from manifold 22 to the corresponding fire zones of the aircraft.

When any of the solenoid coils is energized to open the corresponding valve, the valve core (not shown) physically closes a pair of normally open switches which are respectively designated VC1A and VC1B, VC2A and VC2B, VC3A and VC3B, VC4A and VC4B, and VC5A and VC5B in FIG. 4. Closing of switches VC1A–VC5A applies 12 volts from the 12 volt bus 102 to respective lines 152*a*–152*e* which, as shown in FIG. 3, connect with the respective VO1–VO5 lines 122*a*–122*e* to provide holding circuits that maintain the VO (valve open) lines energized after the corresponding switch 64–68 or 82–84 is released. The other switches VC1B–VC5B are used to visually indicate closing of the corresponding valve.

Referring again to FIG. 4, the VO lines 122*a*–122*e* connect through capacitors 153*a*–153*e* with respective amplifiers 154*a*–154*e* which are tied on their output sides with a common line 156 forming one input to a NAND gate 158. The output from gate 158 is applied to an inverter 160 which connects with a line 162 that leads to the RES' bus 148. The reset (RES) bus 110 also connects via line 162 with the RES' bus 148.

The output signals from the valve latch circuits formed by logic gates 144a–144e and 146a–146e (FIG. 4) are applied, in addition to transistors 150a–150e, to respective lines 164a–164e. Capacitors 165a–165e (4.7 micro F) are tied between the respective lines 164a–164e and ground. Lines 164a–164e connect as one input to respective NAND gates 166a–166e (FIG. 5).

Figure 5:
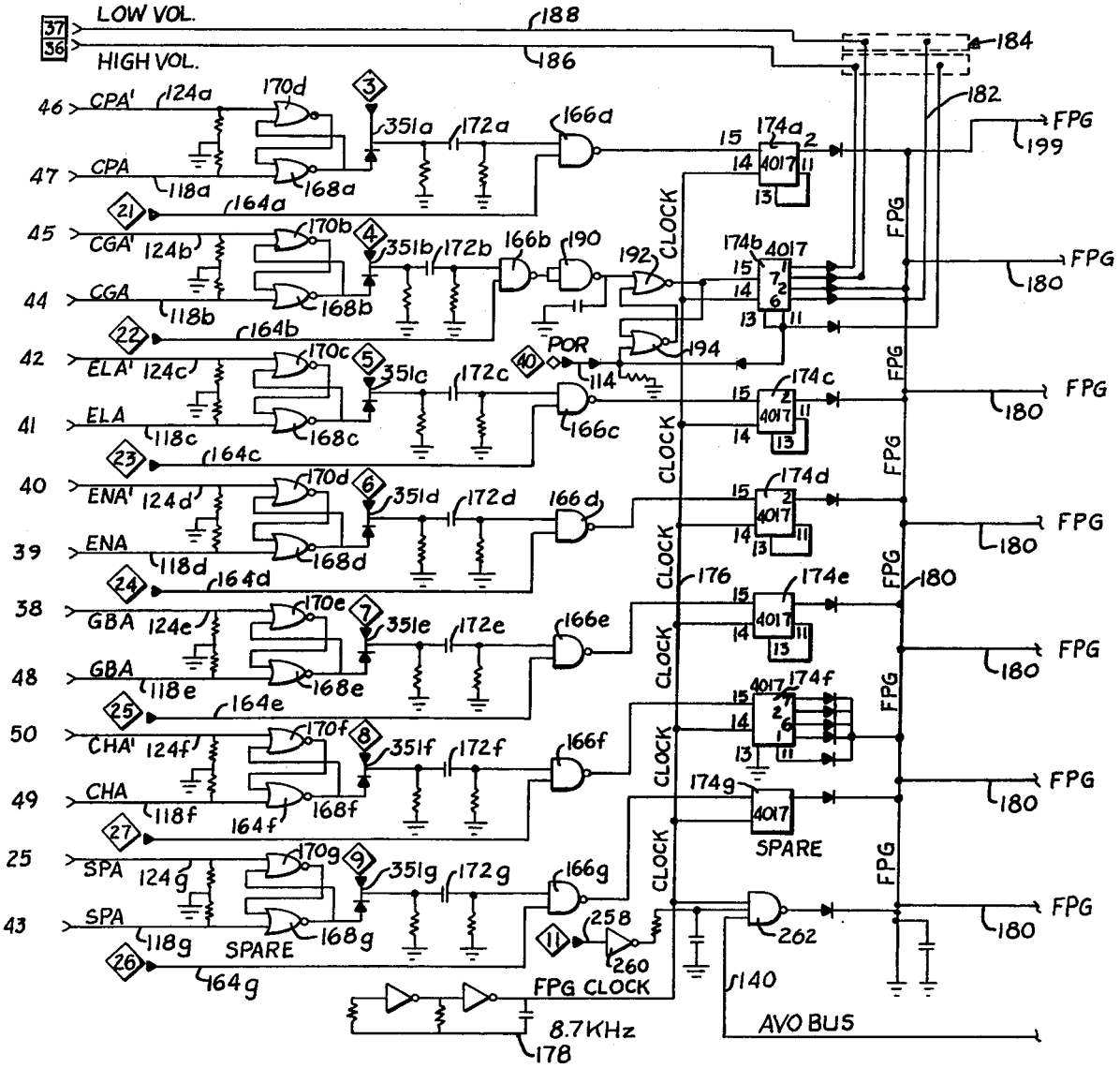

With reference again to FIG. 7, lines 118a–118c are designated CPA, CGA, and ELA, respectively, and connect through pins 47, 44 and 49 of connector 138 with respective NOR gates 168a–168c (FIG. 5). Similarly, lines 118d and 118e (FIG. 8) are designated ENA and GBA and provide one input to respective NOR gates 168d and 168e. The gates 168a–168e form latching circuits in cooperation with associated NOR gates 170a–170e, respectively, which receive one input from the respective lines 124a–124e (designated CPA', CGA', ELA', ENA' and GBA') leading from the push button switches 64–68 and 82–84 (see FIGS. 7 and 8). The output signals from the latch circuits formed by gates 168a–168e and 170a–170e are applied to the respective NAND gates 166a–166e through 0.002 micro F capacitors 172a–172e. As previously indicated, gates 166a–166e have their other input pins connected with lines 164a–164e.

The output lines of gates 166a–166e connect with the "15" input pins of respective decade counter circuits 174a–174e (4017 integrated circuits) having their "14" input pins tied to a common clock line 176. A firing pulse generator (FPG) clock circuit 178 provides 8.7 KHz. pulses to the clock line 176. Each input signal on pin 15 generates an output signal on the "2" output pin of each decade counter 174a and 174c–174e which is applied to FPG bus 180. The decade counters are then inhibited until another input signal appears on pin 15.

The decade counter 174b corresponding to the cargo area of the aircraft has its "2" and "7" output pins tied to the FPG bus 180 and its "6" output pin connected to an open circuit 182 leading to a connector 184. The "1" output pin of decade counter 174b connects through connector 184 with a high volume line 186 which, as shown in FIG. 7, connects with the cargo load switch 72. Line 186 is an open circuit in the "high" setting of switch 72 but connects in the "low" setting of the switch with a low volume line 188. As shown in FIG. 5, line 188 leads back through connector 184 to connection with the FPG bus 180.

The connection of gate 166b and decade counter 174b is not direct but is through an inverter 190 and a latch circuit formed by interconnected NOR gates 192 and 194. The output line of gate 192 connects with the "15" pin of decade counter 174b, and the "11" pin of the decade counter is connected with one input of gate 194.

The circuitry associated with the crash switch 70 differs somewhat from that associated with the fire zone switches 64–68 and 82–84. As shown in FIG. 7, the two common contacts of switch 70 are connected with the 12 volt bus by line 116f. When switch 70 is in the normal position shown, 12 volts is applied through one set of contacts to a CHA line 118f. When switch 70 is depressed, 12 volts is applied through one set of contacts to a VO6 line 122f and through the other set of contacts to a CHA' line 124f.

A pair of amber lamps 126f are located behind the crash switch 70 and are arranged in parallel. One side of each lamp 126f is tied to a line 128f whch connects with the ground line 130, and the opposite sides of the lamps connect with a CSL (crash switch lights) line 196.

The VO6 line 122f connects through pin 4 of connector 138 with the multiple input OR gate 139 (FIG. 3) and continues on to connection with a crash bus 198 (FIG. 4). An inverter 199 connects with the crash bus 198 and provides the second input to NAND gate 158. The crash bus 198 connects with the VO1–VO5 lines 122a–122e and also with a VO7 line 122g which is a spare circuit in the illustrated embodiment of the invention but which can be used with the associated spare components in connection with an additional designated fire zone in the aircraft if desired. Line 122f connects additionally with a NOR gate 144f forming a latch circuit in cooperation with another NOR gate 146f. The output from gate 144f is applied to a series of drivers 197 in order to energize the crash switch lights 126f via the CSL line 196.

Gate 146f connects at one input with the output line from gate 144f and at the other input with the RES' bus 148. The output line from gate 146f connects with one input to gate 144f and also with a conductor 164f. Line 164f is grounded through a capacitor 165f and connects with a NAND gate 166f (FIG. 5). The other input to gate 166f comes from the CHA and CHA' lines 118f and 124f through a latch circuit formed by a pair of logic gates 168f and 170f. The output signal from the latch circuit is applied to gate 166f through a capacitor 172f.

The output from gate 166f connects with the "15" input pin of a decade counter 174f which connects at its "14" pin with the 8.7 KHz clock line 176. Decade counter 174f is identical to decade counters 174a–174e but has its output pins 7, 2, 1, 6 and 11 connected with the FPG bus and its inhibit pin 13 grounded.

Figure 6:
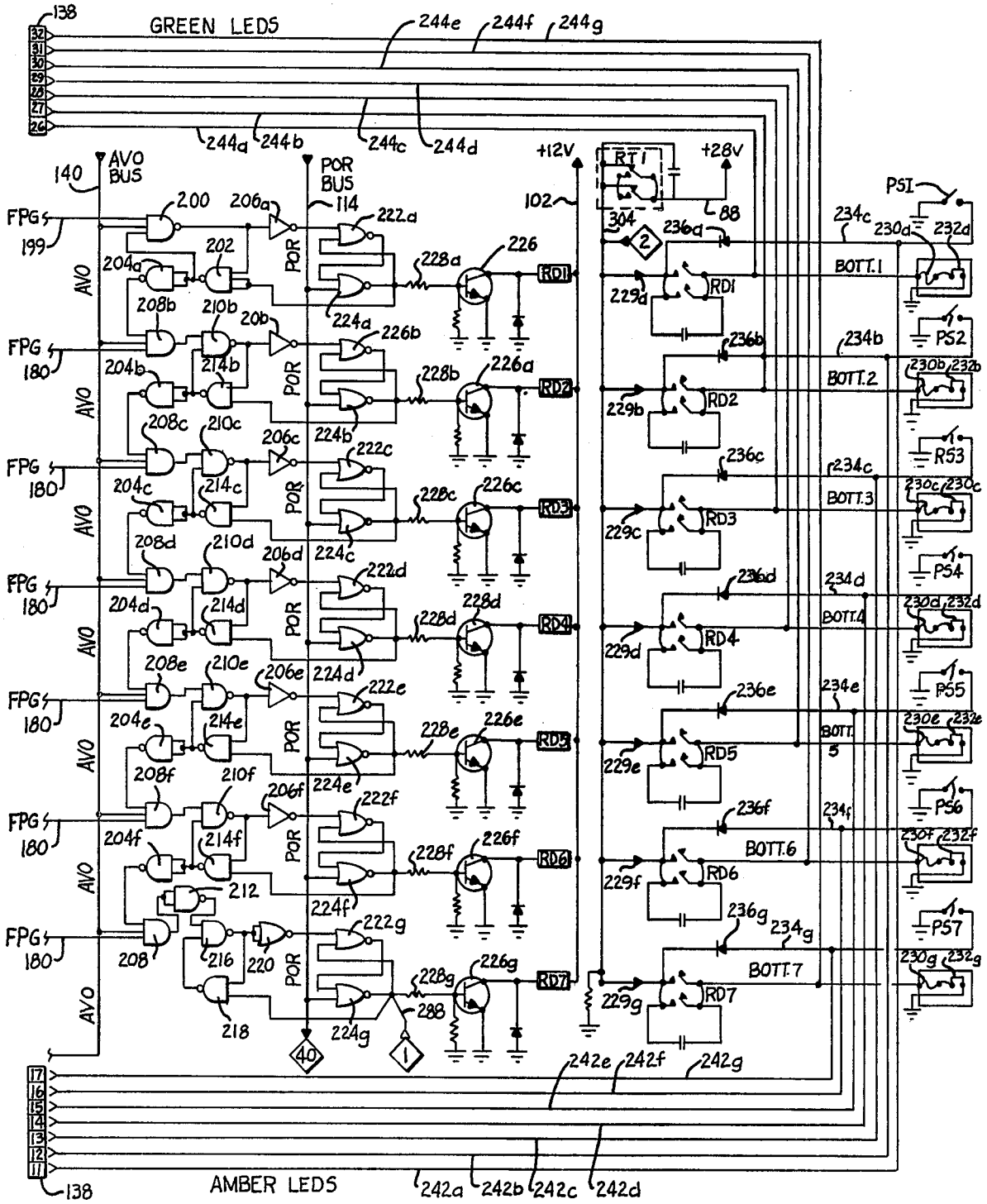

Referring now to FIG. 6, the FPG bus connects via line 199 with one input of a three input NAND gate 200. The AVO bus 140 provides the second input to gate 200, and the third input comes from a NAND gate 202 which also provides the input to inverter 204a. The output from gate 200 is applied to gate 202 and also to an inverter 206a. Gate 200 and the associated circuitry corresponds to the first or number 1 extinguishant bottle 19a.

The FPG bus also connects with a plurality of identical AND gates 208b–208g corresponding to the respective extinguishant bottles 19b–19g. The second input to each gate 208b–208g comes from the AVO bus 140, and the third input comes from the preceding inverter 204a–204f. The output signal from each gate 208b–208f forms one input to a corresponding NAND gate 210b–210f, and the last gate 208g connects with an inverter 212. The output signals from gates 210b–210f are applied to respective inverters 206b–206f and also to respective NAND gates 214b–214f. Gates 214b–214f provide the second input to gates 210b–210f, respectively, and both inputs to the respective inverters 204b–204f.

The inverter 212 corresponding to the last or number 7 bottle 19g provides one input to another NAND gate 216. The output signal from gate 216 is applied to logic gate 218 and inverter 220.

The output signals from inverters 206a–206f and inverter 220 are applied to bottle latch circuits formed by respective pairs of NOR gates 222a–222g and 224a–224g. The output signal from gates 224b–224f are fed back to the respective gates 214b–214f as the second input signal thereto and are also applied to the bases of respective transistors 226a–226f through resistors 228b–228f. Gate 224a provides the second and third inputs to the three input NAND gate 202 and is connected with the base of transistor 226a through resistor 228a. Gate 224g of the last or number 7 bottle latch circuit provides the second input to gate 218 and is connected through resistor 228g with the base of transistor 226g.

When transistors 226a–226g are conductive, circuits are completed to ground from the 12 volt bus 102 through respective relay coils RD1–RD7. The sets of contacts for the respective relay coils are designated RD1–RD7 and normally have power available from the 28 volt bus 8 through the contacts RT1 of a test relay and through respective diodes 229a–229g. When contacts RD1–RD7 are closed due to energization of the corresponding relay coils, the 28 volt bus is connected through the relay contacts with bottle detonator circuits for the number 1–7 extinguishant bottles 19a–19g. The respective detonator circuits include fuses 230a–230g and detonator bridges 232a–232g which connect with ground. When supplied with sufficient current, the bridges 232a–232g actuate respective bottle electrical initiators for the respective bottles 19a–19g to discharge the contents thereof.

Respective pressure switches PS1–PS7 associated with the number 1–7 extinguishant bottles 19a–19g are normally held open by the pressure within the charged bottles but close when the corresponding bottle is discharged and the pressure therein drops. Switches PS1–PS7 are connected on one side with ground and on the other side with respective conductors 234a–234g. The lines 234a–234g have respective diodes 236a–236g and connect with the normally open relay contacts RD1–RD7, respectively.

The 12 volt bus supplies power to an amber LED gang line 238, as shown in FIG. 3. The amber gang line 238 leads to the amber LEDs 80a–80g (see FIG. 7) which connect on their opposite sides with lines 242a–242g, respectively. As shown in FIG. 6, lines 242a–242g connect with the respective lines 234a–234g between diodes 236a–236g and the pressure switches.

The green LEDs 78a–78g connect with the green gang line 142 on one side, as previously indicated. On their opposite sides, LEDs 78a–78g connect with lines 244a–244g, respectively (FIG. 7). As shown in FIG. 6, lines 244a–244g lead to the respective bottle detonator circuits and connect therewith between the relay contacts RD1–RD7 and the fuses 230a–230g.

A conventional impact or gravity switch 246 (FIG. 3) is normally open but closes momentarily in response to the impact involved in a crash of the aircraft. Closing of switch 246 results in the application of power to a conductor 248 provided with a diode 250. Conductor 248 contains the impact switch and connects with the crash line 198 as shown in FIG. 4.

Also connecting with line 248 is a latch circuit formed by a pair of NOR gates 250 and 252. A resistor 254 and capacitor 256 connect one input line of gate 250 with ground. The reset line 110 provides one input to the other gate 252. The output signal from the latch circuit comes from gate 250 and is applied to a conductor 258 which, as shown in FIG. 5, leads to an inverter 260. The output signal from inverter 260 forms one input to a three input NAND gate 262 receiving its other input signals from the AVO bus 140 and the clock circuit 178. The output from gate 262 is applied to the FPG bus 180.

As shown in FIG. 7, the test-reset toggle switch 60 is normally off but connects +12 volts with a manual reset line 264 when moved to the "reset" position. Line 264 leads through pin 35 of connector 138 and through a capacitor 266 (see FIG. 3) to an amplifier 268 which connects with the RES line 110 to provide a reset signal.

When switch 60 is moved to the "test" position, it connects +12 volts with a test line 270 (FIG. 7). The test line 270 leads through pin 34 of connector 138 to RT1 and RT2 relay coils (FIG. 3). Coil RT1 controls the RT1 relay contacts previously mentioned in connection with the bottle detonator circuits shown in FIG. 6.

With continued reference to FIG. 3, the test line 270 connects with an inverter 272 which applies its output signal through a capacitor 274 to a pair of amplifiers 276 and 278 which connect with the POR line 114 and the RES line 110, respectively. Line 270 also connects through another capacitor 280 with another pair of amplifiers 282 and 284. Amplifier 282 connects with the RES line 110, and the other amplifier 284 connects with the POR line 114.

The test line 270 provides one input to an AND gate 286. The second input to gate 286 is applied by a conductor 288 which, as shown in FIG. 6, extends from the output line of the last or number 7 bottle latch circuit formed by gates 222g and 224g. Gate 286 applies its output signal to a NAND gate 290 which receives its other input from another inverter 292. The input to gate 292 comes from a three input AND gate 294. A test clock circuit 296 (operating slowly at about one Hz.) applies one input to gate 294, and test line 270 provides another input.

The test circuitry of the fire protection system also includes a pair of inverters 298 and 300 which provide the input signals to an AND gate 302. The input signal to inverter 300 comes from the test line 270, while the input to inverter 298 comes from a conductor 304 which is connected with or disconnected from the 28 volt bus 88 under the control of the test relay contacts RT1, as shown in FIG. 6.

Gate 302 provides one input to a NOR gate 306 receiving its other input from an AND gate 308. Lines 270 and 304 connect with the input pins of gate 308. The output from gate 306 forms the third input to gate 294 and is also applied to inverter 310. Another NOR gate 312 receives one input signal from inverter 310 and the other from gate 294. The output from gate 294 is also applied to a test circuit (TC) line 314. The output line 316 from NOR gate 312 is a fault light line that leads to light 62, as shown in FIG. 7.

Referring again to FIG. 3, the output line of gate 290 connects with a NAND gate 318 which receives its other input from an inverter 320. The input to inverter 320 comes from gate 318 through a capacitor 322. The output signal from gate 318 is applied to a TC POR line 324 and to an amplifier 326 which connects with the POR line 114.

The output from gate 290 is also applied to input pin 3 of a flip flop circuit 328 which is a D-type flip flop circuit having a second section 330. The output signal from flip flop circuit 328 on pin 1 connects with circuit 330 and with a conductor 332 forming one input line to 3-input AND gates 334a, 334c and 334e. The second output signal from circuit 328 is on pin 2 and is applied to a conductor 336 which forms one input line for 3-input AND gates 334b, 334d and 334f. Three-input AND gate 334g and the associated circuit elements are spare components in the illustrated form of the invention but can be utilized if desired.

Pin 13 of circuit 330 provides the first output signal therefrom and is connected with input pin 3 of another flip flop circuit 338 and with a conductor 340 providing inputs to gates 334*a*, 334*b*, 334*e* and 334*f*. The second output from circuit 330 on pin 9 thereof is applied via line 342 to gates 334*c*, 334*d* and 334*g*. The 1 output pin of circuit 338 is connected to line 344 which applies input signals to gates 334*a*–334*d*. Line 346 connects with output pin 2 of circuit 338 and with gates 334*e* and 334*f*. Circuit 338 has a second section 348 with output lines connected to gate 334*g*.

The output signals from gates 334*a*–334*f* are applied to respective AND gates 350*a*–350*f* which receive their other inputs from the TC line 314. Gates 350*a*–350*f* apply signals to respective conductors 351*a*–351*f* which connect through diodes with the output lines from the latch circuits formed by gates 168*a*–168*f* and 170*a*–170*f*, as shown in FIG. 5. Gates 350*a*–350*f* also connect with respective inverters 352*a*–352*f* which in turn connect with the bases of respective test transistors 354*a*–354*g*. When the test transistors are conductive, they provide circuit paths for applying +12 volts to test valve open lines (TVO1–TV06) which are designated 356*a*–356*f*, respectively. As shown in FIG. 4, the TVO lines 356*a*–356*f* connect with the corresponding VO lines 122*a*–122*f*.

Referring again to FIG. 3, lines 332, 342 and 346 connect with the three input pins of an AND gate 358 which applies its output to a NOR gate 360. The RES line 110 provides the other input to gate 360, and its output is applied through an inverter 362 to the #6 pins of circuits 328 and 338 and the #8 pins of circuits 330 and 348. The output from gate 360 is also applied to a NAND gate 364 having its output applied through a capacitor 366 to an inverter 368. The inverter 368 provides the second input to gate 364. The output line 370 of gate 364 is connected through a capacitor 372 to an amplifier 374, as shown in FIG. 4. The output line of amplifier 374 connects through a diode 376 with one input to NAND gate 158.

The fire protection system is placed in operating condition by closing the circuit breaker (not shown) that connects the power supply with the 28 volt lines 86 and 88. The voltage regulator then provides power for the 12 volt bus 102 and applies a reset pulse on the RES line 110 through capacitor 108 and amplifier 106 and a POR pulse on line 114 through capacitor 108 and amplifier 112. Among other functions, the RES and POR pulses that pass through capacitor 108 generate a signal on RES' line 148 (FIG. 4) which resets the valve latch circuits formed by gates 144*a*–144*e* and 146*a*–146*e* and also resets the latch circuit formed by gates 144*f* and 146*f*. In addition, the POR pulse resets the bottle latch circuits formed by gates 222*a*–222*g* and 224*a*–224*g* (see FIG. 6).

In operation of the fire protection system, a fire in any of the designated fire zones is either detected by a suitable detection system or is sensed by the pilot of the aircraft or other personnel. In the event of a fire in the cockpit 10, for example, the cockpit switch 64 is pushed once to arm the system by opening valve 26 and is pushed subsequently one or more times to discharge one or more of the extinguishant bottles 19*a*–19*g* in order to apply extinguishant to manifold 22 and through the open valve 26 and conduit 24 to the cockpit nozzles 44.

When switch 64 is depressed initially, its contacts are moved from the normal position shown in FIG. 7 such that the green cockpit lights 126*a* are energized beneath the lower "ARMED PUSH TO DISCHARGE" section of the cockpit switch 64 (see FIG. 2). This provides a visual indication on the cockpit switch that the system is armed and will apply extinguishant upon another depression of the switch.

Depression of switch 64 also applies +12 volts to the VO1 line 122*a* which connects with the multiple input OR gate 139 shown in FIG. 3. The resulting output signal from gate 139 is applied to the AVO bus 140 and to the base of transistor 141 to make the transistor conductive, thus applying +12 volts to the green LED gang line 142. The VO1 line 122*a* also applies power to the latch circuit formed by gates 144*a* and 146*a* (FIG. 4). The high output from the latch circuit is applied to the base of transistor 150*a* to make the transistor conductive. Relay coil RV1 is thereby energized, and the RV1 relay contacts connect +28 volts with solenoid coil VC1 to effect opening of the cockpit valve 26.

When solenoid VC1 is energized, contact VC1A connects +12 volts with line 152*a* which in turn connects with the VO1 line 122*a* as shown in FIG. 3. This completes the holding circuit which bypasses switch 64 and thereafter maintains valve 26 open when switch 64 is released following its initial depression. The holding circuit maintains power on the VO1 input to OR gate 139 and on solenoid coil VC1 until the RES' line 148 is energized to reset the latch circuit formed by gates 144*a* and 146*a*.

With power on the green LED gang line 142, a current path to ground is completed through the green LEDs 78*a*–78*g*, lines 244*a*–244*g* and the respective bottle detonator circuits which include fuses 230*a*–230*g* and detonator bridges 232*a*–232*g*. If any of the extinguishant bottles 19*a*–19*g* has been used, its detonator bridge will be broken to break the circuit that would otherwise energize the corresponding green LED 78*a*–78*g*. Thus, the green LEDs that are energized on the control panel 54 indicate which bottles are available, and the absence of a green light for a particular bottle indicates that such bottle has already been used and is unavailable.

It is important to note that the circuits that are completed through the detonator bridges 232*a*–232*g* are powered by 12 volts and pass through the green LEDs 78*a*–78*g* (and their internal resistances) as well as the associated 2.2 Kohm resistors. The current passing through the detonator bridges is thus relatively small and is insufficient to detonate the bridges. Typically, the current applied to the bridges in this situation is on the order of about 10 milliamps, whereas about 200 to 500 milliamps is required to detonate the bottles.

Referring again to FIG. 7, it is noted that depression of switch 64 applies 12 volts to the CPA' line 124*a*, and that the signal on line 124 is applied to gate 170*a* (FIG. 5) to activate the associated latch circuit. A pulse is thereby applied momentarily through the 0.002 micro F capacitor 172*a* to gate 166*a*. The capacitor 172*a* quickly becomes charged, and the high input signal to gate 166*a* is then removed since current no longer passes through the charged capacitor. The other input to gate 166*a* comes from line 164*a* and is delayed until capacitor 165*a* (FIG. 4) is fully charged. Due to the relatively large capacitance of capacitor 165*a* (4.7 micro F) compared to that of capacitor 172*a* (0.002 micro F) the momentary high signal applied to gate 166*a* through capacitor 172*a* is no longer present when the high signal on line 164*a* reaches the other input of gate 166*a*. Consequently, there is no output generated from gate 166a upon initial depression of switch 64, and decade counter 174a remains inactive and does not apply a firing pulse to the FPG bus 180.

When switch 64 is depressed a second time, the CPA' line 124a is once again energized and a second momentary high signal is applied to gate 166a through capacitor 172a. Since the holding circuit continuously maintains the VO1 line 122a in a high state, line 164a remains continuously high, and gate 166a receives two high inputs the second time switch 64 is depressed. The resulting pulse applied to pin 15 of decade counter 174a generates an output pulse on pin 2 which is applied to the FPG bus 180 and to one input pin of each gate 200 and 208b–208g (FIG. 6).

At this time, the output from each inverter 204a–204f is low, so none of the gates 208b–208f provides an output signal in response to the firing pulse on the FPG bus 180. However, gate 202 provides a high output which is applied as one input to gate 200. The other inputs to gate 200 come from the FPG bus 180 (via line 199) and from the AVO bus 140 which is maintained in a high state by the OR gate 139. Gate 200 is thus active and provides a pulse to inverter 206a which in turn activates the bottle latch circuit formed by gates 222a and 224a. The output signal from gate 224a is applied to the base of transistor 226a, thereby making the transistor conductive and energizing relay coil RD1. The associated relay contacts RD1 then complete the 28 volt circuit through the detonator bridge 232a to discharge the number one bottle 19a. Extinguishant is directed through the open valve 26 to the cockpit 10 and is applied to the cockpit fire through nozzles 44.

It should be apparent that discharge of the extinguishant bottle cannot occur unless valve 26 is open because line 164a (i.e. valve latch 144a–146a "on") and the AVO bus 140 (i.e. valve 26 energized and moved to the open position, thus closing the contacts of switch VC1A) are in the high state only if there is a signal on the VO1 line 122a indicating that the valve is open. In this manner, the circuitry assures that there is a valve open before it is possible to detonate any of the bottles.

If one bottle of extinguishant is insufficient to control the fire, switch 64 can be depressed repeatedly to discharge a subsequent bottle for each subsequent depression of the switch. When switch 64 is depressed for the third time, a second firing pulse is applied to the FPG bus 180 in the same manner as the first firing pulse. Following the first firing pulse, the output line of gate 200 reverts to its normal high state and provides a high input to gate 202. The other inputs to gate 202 are also high because the output line from gate 224a is latched in a high state in the absence of a POR reset pulse on line 114. Gate 202 thus provides a low output which is applied to gate 200 such that it is inactive at the time the second firing pulse reaches it. However, gate 208b is active at this time since inverter 204a provides a high input to it and the AVO bus 140 remains in a high state. Thus, AND gate 208b applies a high input signal to NAND gate 210b which has a high signal on its other input pin. Gate 210b provides a pulse through inverter 206b and activates the latch circuit formed by NOR gates 222b and 224b. Transistor 226b is then conductive and the RD2 relay contacts close to apply 28 volts to detonator bridge 232b for detonation of the second bottle 19b.

Subsequent depressions of switch 64 effect detonation of bottles 19c–19g in sequence in the same manner. Each time a bottle is discharged, the associated detonator bridge 232a–232g is destroyed and the path to ground through the corresponding green LED 78a–78g is interrupted. Each time a bottle is discharged, the corresponding pressure switch PS1–PS7 closes due to the pressure drop in the bottle. This completes a circuit path to ground for the corresponding amber LED 80a–80g. Consequently, each bottle that is discharged results in energization of the associated amber LED 80a–80g and deenergization of the associated green LED 78a–78g to provide a visual indication that the bottle has been discharged and is no longer available.

Each of the switches 66–68 and 82–84 for the remaining fire zones can be depressed once to open the corresponding valve in the same manner described in connection with the cockpit valve 26 and subsequently to discharge one or more extinguishant bottles, also in the manner described previously. The number of bottles that are discharged for each depression of the cargo switch 66 following the first depression depends upon the setting of the volume selector switch 72. With reference to FIG. 5, each pulse applied to the input pin 15 of the decade counter 174b associated with the cargo compartment effects four output pulses in sequence on output pins 2, 7, 4 and 6. The first two output pulses on pins 2 and 7 are applied directly to the FPG bus 180 and thus effect detonation of bottles 19a and 19b (or the first two available bottles) in sequence in the manner described previously. The output on pin 1 is applied to line 186 and has no effect if switch 72 is in the "full cargo" setting shown in FIG. 7. However, if switch 72 is set in the "empty cargo" position, line 186 is connected with line 188 and the output pulse appearing on pin 1 of circuit 174b is applied to the FPG bus 180 to effect detonation of the third bottle 19c (or the third available bottle). The fourth output pin (number 6) leads to an open circuit in the illustrated form of the invention, and the final pulse applied to pin 11 of circuit 174b resets the latch circuit formed by gates 192 and 194, as does a POR signal on the POR line 114.

It is to be understood that any or all of the fire zones can be equipped with a volume selector switch similar to switch 72 such that a larger or smaller quantity of extinguishant can be applied for each depression of the corresponding push button switch, depending upon the volume selector switch setting. Also, any desired number of bottles can be discharged in either the "full cargo" or "empty cargo" setting of each volume selector switch.

In the event that one of the valves is open and another push button switch 64–68 or 82–84 is depressed, the previously open valve closes automatically and the valve associated with the push button switch opens. For example, if the cockpit valve 26 is open and a fire appears in the electrical compartment 14, depression of the electrical compartment switch 68 closes valve 26 and opens valve 38 so that subsequent depression of switch 68 applies all of the discharged extinguishant into the electrical compartment. When switch 68 is depressed, the VO3 line 122c is energized in the manner described previously, and, as shown in FIG. 4, operates the valve latch circuit (gates 144c and 146c) associated with valve 38, thus opening valve 38. The VO3 line 122c (and all other VO lines except VO6) also connects with line 156 (through amplifier 154c and the associated capacitor 153c) to apply, through the capacitor, a pulse which forms one input to NAND gate 158. Unless the crash line 198 is in a high state, the other input to gate 158 through inverter 199 is always high, and gate 158 and inverter 160 apply a high pulse to line 162 which is in turn applied to the RES' line 148 to reset all of the valve latch circuits (gates 144a–144e and 146a–146e). This RES' pulse is only momentary (due to the capacitor 153c) and closes the previously open cockpit valve 26 and all other valves. The momentary RES' pulse on line 148 has disappeared before the electrical compartment switch 68 is released, and the VO3 line 122c is thus energized subsequent to the RES' pulse in order to open the electrical compartment valve 38.

In this fashion, depression of any of the push button switches 64–68 and 82–84 closes all valves except for the valve associated with the switch that is depressed. If it is desired to open two or more of the valves simultaneously, the corresponding push button switches can be depressed simultaneously and the desired valves will open since the RES' pulse will have passed before the push button switches are released.

The POR line 114 is activated when the system is initially provided with power or when placed in the test mode. As shown in FIG. 6, the POR line 114 resets the bottle latch circuits formed by gates 222a–222g and 224a–224g. Also, the POR line 114 resets the latch circuit formed by gates 192 and 194 (FIG. 5) and connects with the RES' line 148 (FIG. 4) to reset the valve latch circuits.

If a crash of the aircraft is imminent, the crash switch 70 can be pushed once to open all valves and again to discharge all of the extinguishant bottles into all of the fire zones. Depression of switch 70 applies 12 volts to the VO6 line 122f which activates OR gate 139 to apply power to the AVO bus 140 and the green LED gang line 142. The VO6 line 122f connects with the crash line 198 which in turn connects with all of the VO lines 122a–122e, as shown in FIG. 4. The VO6 line thus activates all of the bottle latch circuits to effect energization of all of the valve solenoid coils VC1–VC5 and opening of all valves 26, 30 and 38–42. The holding circuits associated with the VO1–VO5 lines thereafter maintain all valves open. It is noted that when the crash line 198 is in a high state, there is a low input to gate 158 through inverter 199. Once the crash switch is released, the other input to gate 158 is low because the capacitors 153a–153e are then fully charged. Consequently, gate 158 does not activate RES' line 148 and the valve latch circuits are not reset when the crash switch is pushed.

The VO6 line 122f activates the latch circuit formed by gates 144f and 146f and, through the drivers 197, activates line 196. As shown in FIG. 7, line 196 leads to ground line 128f through the crash lights 126f, and the crash lights are energized to light the "ARMED PUSH TO DISCHARGE" portion of switch 70 after it has been depressed once.

The second depression of crash switch 70 provides a high signal on line 164f which, in conjunction with the signal on the CHA' line 124f activates gate 166f. Decade counter 174f then applies repeated firing pulses to the FPG bus 180, and the bottles 19a–19g are detonated in sequence by the firing pulses in the manner previously described.

If a crash should occur before there is time or opportunity to activate the crash switch 70, the impact switch 246 closes on impact and effects opening of all valves and detonation of all bottles. Closing of switch 246 applies power to line 248 and the crash line 198. All valves are thus immediately opened by the crash line as previously described. With reference to FIG. 3, closing of switch 246 activates the latch circuit formed by gates 250 and 252 only after the 50micro F capacitor 256 has been fully charged. Thus, line 258 is energized, but only after a time delay sufficient to assure that all of the valves have been opened. As shown in FIG. 5, the signal on line 258 passes through inverter 260 and is applied to gate 262. Since all valves are open, the AVO line is in a high state and gate 262 provides repeated firing pulses to the FPG bus 180 each time the clock line 176 is cycled high. These firing pulses effect discharge of all of the extinguishant bottles 19a–19g in sequence, and the extinguishant is directed throughout the aircraft since all valves are open. If there is only time to push switch 70 once before a crash occurs, the bottles are all discharged in the same manner.

It should be understood that extinguishant can be automatically applied to the aircraft in the same manner in the event of any other preselected event, such as the occurrence of a fire in an aircraft parked on the ground, in addition to a crash. If a fire should occur in the aircraft, a smoke or heat detector senses the fire and, after a suitable time delay, automatically effects activation of the "crash" sequence, thereby discharging all of the bottles into all of the fire zones.

Prior to the takeoff or at any other time, the fire protection system can be tested by moving the test-reset toggle switch 60 to the "test" position. Power is then applied to the test line 270. A reset pulse is applied to the RES line 110 through amplifier 282 in order to reset all of the valve latch circuits to the idle state. Also, a POR pulse is applied through amplifier 284 to the POR line 114 to reset all of the bottle latch circuits.

Test line 270 also energizes relay coils RT1 and RT2. Coil RT2 is available for use in a fire detection system (not shown). Coil RT1, when energized in the test mode, opens its relay contacts RT1 (FIG. 6) so that power from the 28 volt bus 88 is unavailable to the bottle detonator relay contacts RD1–RD7.

Referring again to FIG. 3, the test line 270 applies one input to AND gate 286. The other input of gate 286 is low on line 288 unless the bottle latch circuit (gates 222g and 224g) associated with the last or No. 7 bottle 19g provides a high output to effect detonation of the No. 7 bottle (see FIG. 6). Gate 286 thus normally applies a low input to NAND gate 290, and a high output results from gate 290 and is applied to input pin 3 of flip flop circuit 328. The first output pulse from circuit 328 is applied to output pin 1 and to AND gate 334a. In the idle condition of circuits 330 and 338, lines 340 and 344 are in the high state, and gate 334a thus provides a high input to gate AND 350a. The other input to gate 350a comes from the TC line 314.

The signal on line 314 comes from AND gate 294 which, in the test mode, has one high input from test line 270 and a cycling high/low input from the slow (1 Hz) test clock circuit 296. Since line 304 is disconnected from power due to the opening of the test relay contacts RT1 (see FIG. 6) in the test mode, line 304 is in a low state and provides a low input to inverter 298 and AND gate 308. The test line 270 provides a high input to inverter 300 and to gate 308. AND gates 302 and 308 provide low inputs to NOR gate 306 which applies a high output as the third input to gate 294. The signal on the TC line 314 is thus a high/low cycling pulse providing in the low state an output from gate 350a which, through inverter 352a, makes transistor 354a conductive to energize the TVO1 line 356a. As shown in FIG. 4, the TVO1 line 356a connects with VO1 line 122a and causes valve 26 to open as described previously. Once valve 26 has opened, its holding circuit established through contact VC1A maintains it open.

The signal applied to inverter 352a is also applied to line 351a and, through capacitor 172a (FIG. 5) to gate 166a. When the first pulse reaches gate 166a, line 164a is in a low state since the VO1 line 122a is low at that time. However, when the second pulse reaches gate 166a, line 122a is in a high state (due to the opening of the first valve) and line 164a is also high. Therefore, gate 166a is active and activates decade counter 174a which applies a firing pulse to the FPG bus 180.

The initial firing pulse applied to FPG bus 180 in the test mode activates gate 200 and effects closing of the RD1 contacts. The RT1 contacts are open in the test mode, and the 28 volt bus 88 is disconnected from all of the RD1-RD7 relay contacts. However, 12 volts is applied to line 234a through the number 1 amber LED line 242a, and the circuit is completed to ground through diode 236a, the closed RD1 contacts and detonator bridge 232a. The amber LED 80a associated with bottle 19a is energized to provide a visual indication simulating detonation of bottle 19a in the test mode of operation. Only 12 volts is applied to bridge 232a and the circuit includes the internal resistance of LED 80a and the associated 2.2 Kohm resistor, so the current passing through bridge 232a is insufficient to detonate it. However, this method provides a functional complete check of the entire system as it would be operated in normal conditions and confirming the ability of each component to perform its intended funtion.

The subsequent pulses which are generated on line 351a by the cycling high/low TC line 314 are applied in sequence to circuit 174a since line 164a remains in a high state due to the constant high state of the VO1 line 122a. The resulting pulses which are applied by circuit 174a in sequence to the FPG bus 180 close relay contacts RD2-RD7 in sequence in the same manner as occurs when one of the push button switches is depressed repeatedly. Due to the availability of 12 volts through the amber LEDs 80b-80g and the associated lines 242b-242g, circuits are completed in sequence through diodes 236b-236g and contacts RD2-RD7, and the amber LEDs are energized in sequence to simulate detonation of the respective extinguishant bottles. In each case, insufficient current passes through the detonation bridges to effect detonation.

When the transistor 226g associated with the number seven bottle 19g is energized to simulate detonation of bottle 19g, line 288 is in a high state, and both inputs to gate 286 are then high to provide a high input to gate 290. The other input to gate 290 cycles high/low in accordance with the test clock circuit 296, since the cycling output signal from gate 294 is applied to inverter 292 which connects with gate 290. The output signal from gate 290 thus provides a pulse that sets flip flop circuit 328 to the next stage of operation.

The output signal from gate 290 is also applied to NAND gate 318. Inverter 320 applies a high input to gate 318 which provides a cycling high/low output to amplifier 326. A high signal is thus applied to the POR line 114 after the capacitor 115 has been charged. The POR signal on line 114 resets the bottle latch circuits (gates 222a-222g and 224a-224g) after a time delay sufficient to charge capacitor 115. The output from gate 318 is applied to the TC POR line 324 which, without delay, applies a signal to the RES' line 148 (FIG. 4) through line 162, and the valve latch circuits (gates 144a-144e and 146a-146e) are reset before the bottle latch circuits. All valves are thereby closed prior to resetting of the bottle latch circuits.

After the valve and bottle latch circuits have been reset and flip flop circuit 328 has been advanced to the next stage, the next pulse from circuit 328 is applied to pin 2 and causes AND gate 334b to provide a high input to AND gate 350b. The cycling high/low state of the TC line 314 results in an output signal from gate 350b which is applied through inverter 352b to transistor 354b. The TVO2 line 256b is then activated, and since it connects with the VO2 line 122b (see FIG. 4), the second valve 30 is opened and maintained open by its holding circuit.

The output from gate 350b is also applied to line 351b, which charges capacitor 172b, thus generating a pulse on one input of gate 166b. Since lines 122b and 164b are inactive at the time of the initial output signal from gate 350b, both conditions of gate 166b are not satisfied. The pulse thus opens valve 30 but does not apply a firing pulse to the FPG bus 180. However, the next pulse does result in a firing pulse since the VO2 line 122b and line 164b are in a high state at the time gate 166b receives a high signal pulse from 351b. The signal which is then applied to decade counter 174b simulates the detonation of the first bottle 19a in the manner described previously. Subsequent pulses simulate detonation of the remaining bottles 19b-19g in sequence, and the circuitry then resets all valve latch and bottle latch circuits before opening the third valve 38 and simulating the detonation of bottles 19a-19g in sequence, resetting, opening the fourth valve 40 and simulating the detonation of bottles 19a-19g in sequence, resetting, opening the last valve 42 and simulating the detonation of bottles 19a-19g and resetting. The final test valve open line which is the TVO6 line 356f opens all valves via the crash line 198; and via the VO6 line, the latch circuit formed by gates 144f-146f, and drivers 197 energizes the crash switch lights in switch 70 via line 196. With the crash circuit thus "armed" by the test sequence, the next pulse on line 351f discharges all bottles 19a-19g through gate 166f FPG circuit 174f and 180, and RD1-RD7 as previously described. Also as previously described, when bottle latch circuit 222g-224g is active, a high signal is generated on line 288 which resets all valve and bottle latch circuits while the flip flop circuit 328-330-338-348 returns to time zero because AND gate 358 decodes the end of count sequence and generates a re-initializing pulse via NOR gate 360 and in inverter 362 on line 500. With the test switch still in test, the next pulse from gate 290 begins the test sequence again with the first valve 26.

Moving switch 60 to the "test" position thus generates a test sequence which opens all valves one at a time and simulates the detonation of all bottles each time a valve is open. The crash test is also performed, and the circuitry resets and cycles automatically through the test sequence until the test switch 60 is moved to the "off" or "reset" position. Each valve that opens during the test sequence effects energization of the corresponding indicator lights 126a-126e to indicate that the valve has actually opened, and the crash lights 126f are energized during the "crash" portion of the test sequence. Each time the test circuitry opens a valve, all 7 green LED's are indicating that the current path through each bottle initiator 232a-232g is operable. The test circuit then energizes the corresponding amber LED 80a-80g as each detonate circuit is activated to indicate that the current path through the corresponding detonator circuit is available if needed to combat a fire. All latch circuits are reset when the system is taken out of the test mode since test line 270 then reverts to a low state and a reset pulse is generated on RES line 110 through inverter 272 and amplifier 278 and a POR pulse is generated on POR line 114 through inverter 272 and amplifier 276.

As previously indicated, gate 306 provides a high output in the test mode. Inverter 310 thus provides a low input to gate 312, and the other input signal is the high/low cycling output from gate 294. The result is that line 316 is cycled between high and low states. Consequently, the amber light 62 on the control panel flashes on and off to provide a visual indication that the system is operating in the test mode.

If the system is placed in the test mode of operation and the test relay for some reason malfunctions and fails to open the test relay contacts RT1, the amber light 62 is constantly on to indicate the presence of a fault in the system. If the RT1 contacts remain closed, line 304 (FIG. 6) is in a high state since it is directly connected with the 28 volt power bus 88. As shown in FIG. 3, line 304 connects with inverter 298 which then provides a low input to gate 302, resulting in a low input to gate 306. The other input to gate 306 comes from gate 308 and is high because lines 270 and 304 are both in a high state. The output from gate 306 is thus low, and the output from inverter 310 is high to provide a low output on line 316 from gate 312. Since the opposite side of the amber light 62 is connected with +12 volts, light 62 is steadily energized when line 316 is in a constant low state, and the light visually indicates that there is a fault in the system. Also, the low output of gate 306 is connected to gate 294. This prevents passage of the test pulse from clock 296 and thus stops the test sequence to prevent inadvertent discharge of bottles **19*a*–19*g***.

Another potential fault condition exists if the system is out of the test mode but 28 volts is not available to the bottle detonator circuits, due to the failure of the test relay contacts RTI to close or for any other reason. The amber light 62 again is energized constantly in this situation to indicate the presence of a fault condition. The lack of power to line 304 places it in a low state, and inverter 298 provides a high input to gate 302. The other input to gate 302 comes from inverter 300 and is also high since the test line 270 is in a low state. Gate 302 thus provides a high signal to gate 306 which in turn provides a low input to the inverter 310. The resulting high input to gate 312 places line 316 in a constantly low state and energizes light 62 to provide a steady visual indication of the fault so that corrective measures can be taken.

It is thus apparent that the fire protection system permits extinguishant material to be applied in the necessary quantity to extinguish a fire in any of the fire zones of the aircraft, and that the extinguishant is directed to the appropriate location through the valves which are accurately controlled by the circuitry and opened before the extinguishant bottles are detonated. At the same time, all of the controls are conveniently located on the control panel 54, and only one switch must be depressed to extinguish a fire in any one fire zone. The "ARMED" indicator lights that are built into the push button switches indicate the status of each valve, and the bottle lights **78*a*–78*g* and 80*a*–80*g* indicate the status or availability of the individual extinguishant bottles 19*a*–19*g***.

The test circuitry is operated as easily as the controls which actually apply extinguishant to a fire, and the simplicity of the test procedure increases the likelihood that the system will be tested frequently to enhance its reliability. The test mode requires only that a single switch (62) be moved and results in an easily observed indication that the system is in test, that each valve is actually opened, and that each bottle detonator circuit and the bottles are in working condition.

The test circuitry also displays faults in the control panel, and its lamps, valves, bottles and computer module. The lamps are visually inspected as the test sequence operates. A valve that fails to open is shown by the corresponding control panel switch "armed" light flashing on and off as the test pulses attempt to activate the failed valve. A valve that is stuck open when deenergized displays a steady "armed" light in its corresponding central panel switch. A faulty bottle is shown by its corresponding green LED not being illuminated at the time any valve is open but its corresponding amber LED illuminating in sequence by the test circuit. An empty bottle is shown by the corresponding amber LED being on at all time and the corresponded green LED failing to illuminate when any valve is opened. A computer module fault with the test relay is shown by the flashing amber LED becoming steady, and if in "test" the test sequence stops.

FIGS. 9 and 10 depict an alternative form of the invention which is in many respects similar to the embodiment described previously. Components in the second embodiment that are identical to or similar to components found in the first embodiment are referred to by the same numerals in FIGS. 9 and 10 as are used in FIGS. 1–8.

The embodiment of FIGS. 9 and 10 is simplified somewhat and is intended for use in an aircraft having only a small number of fire zones such as three, for example, namely a left engine compartment (engine No. 1), a right engine compartment (engine No. 2) and a cabin area. As shown in FIG. 9, only five bottles of extinguishant material (**19*a*–19*e*) are provided in the aircraft, although a greater or smaller number of bottles is possible. The bottles connect with a common manifold line 22 which leads to the inlet port of a three way solenoid valve 500 (valve No. 1). When the coil of valve 500 is deenergized, the deenergized port (DE) is connected with the inlet port, and incoming extinguishant is directed into the cabin of the aircraft. The energized port (E) of valve 500 connects with a line 502 leading to the inlet port of another three way solenoid valve 504 (valve No. 2). The deenergized port (DE) of valve 504** applies extinguishant to the left engine compartment, and the energized port (E) applies extinguishant to the right engine compartment.

In this manner, the two three way valves 500 and 504 control the flow of extinguishant to three fire zones. It should be pointed out that the system of FIGS. 9 and 10 can also be employed with two way valves. In this case, as will be explained more fully, each fire zone has a two way valve connected with the common manifold line 22. Components that are not present when three way valves are used are enclosed by broken lines and components that are not present when two way valves are used are enclosed by solid lines.

Figure 10A:
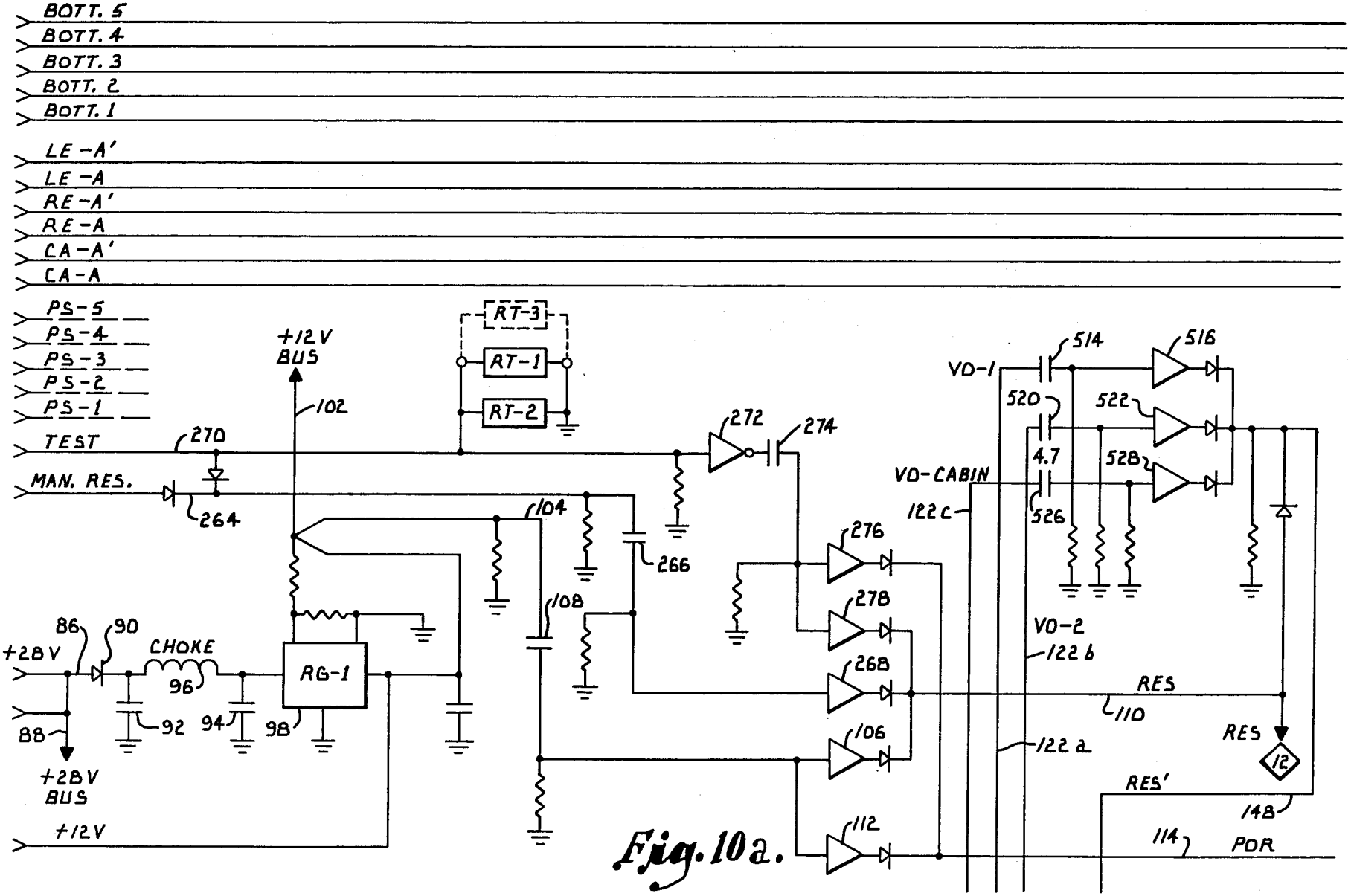

Referring now to FIG. **10*a*, the fire protection system includes a power supply of the same type described previously, and the same reference numerals are used in FIG. 10*a*** to designate similar components. Each fire zone has a push button switch similar to those shown in FIG. 2 and associated circuitry similar to that of FIG. 7. Thus, when the respective push button switches are depressed, a VO-1 line 122*a*, a VO-2 line 122*b* and a VO-cabin line 122*c* are provided with power (see FIG. 10*d*). With continued reference to FIG. 10*d*, the VO-1 line 122*a* leads to a valve latch circuit formed by gates 144*a* and 146*a*, and the VO-2 line 122*b* connects with a valve latch circuit formed by gates 144*b* and 146*b*. The VO-cabin line 122*c* connects with a three input AND gate 506 having on its output line inverter amplifiers 508 and 510 which connect with a valve latch circuit formed by gates 144*c* and 146*c*. The other two inputs to gate 506 are on valve idle lines 542 and 544 (VIDL-1 and VIDL-2) that are energized when the respective valves 500 and 504 are idle or deenergized. The components within the solid box 511 are omitted if two way valves are employed rather than three way valves.

Figure 10B:
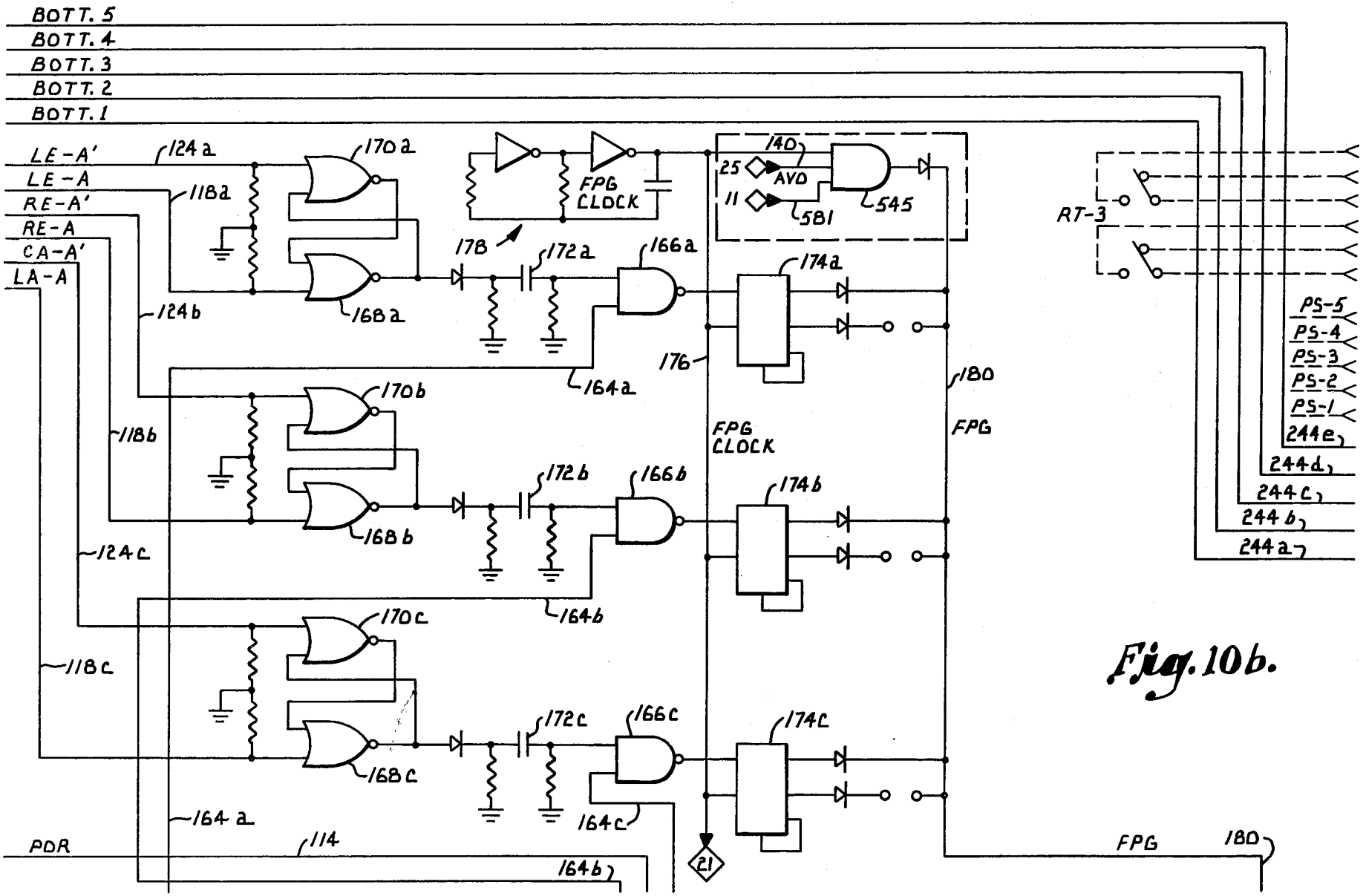
Figure 10C:
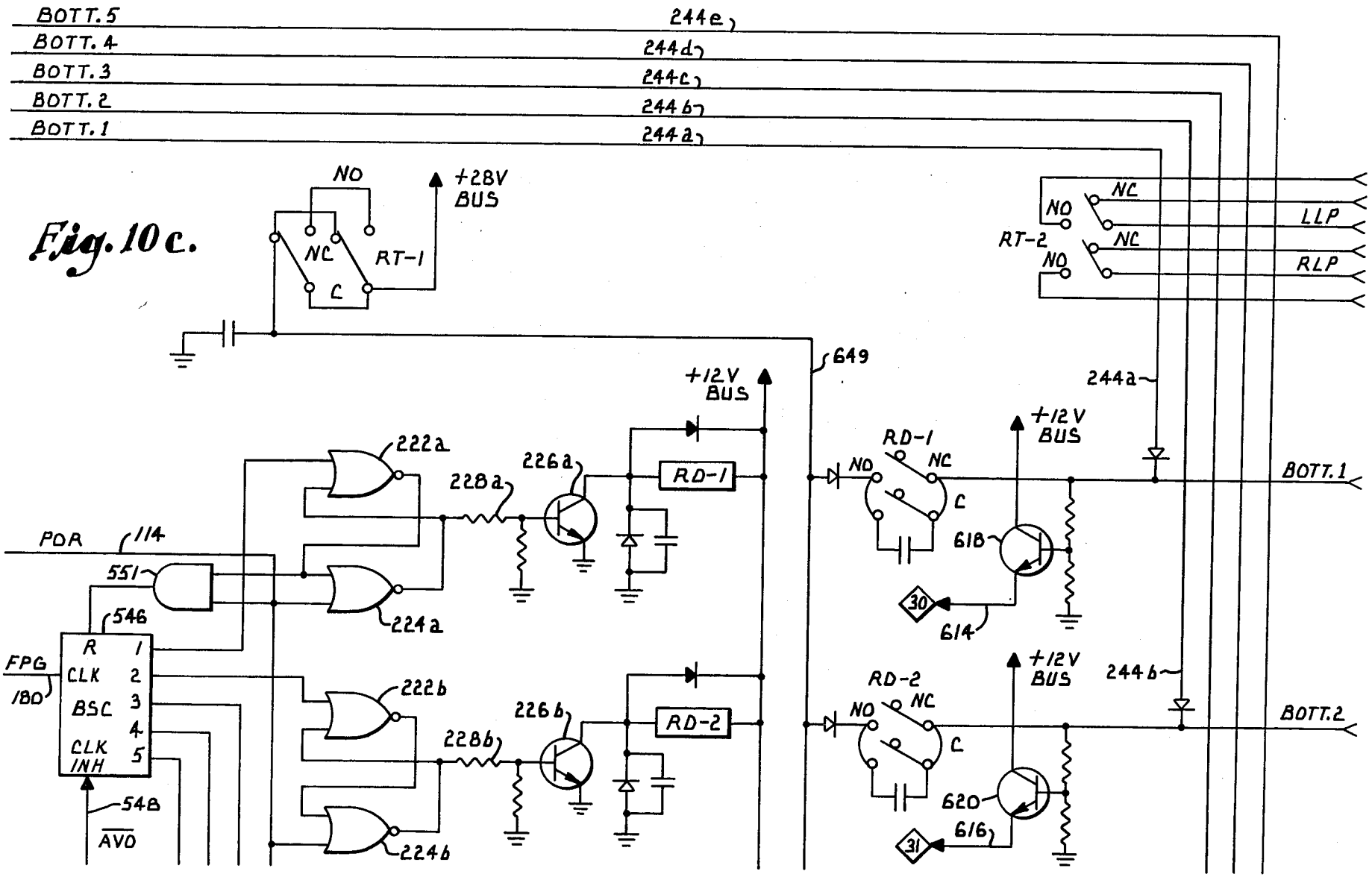
Figure 10D:
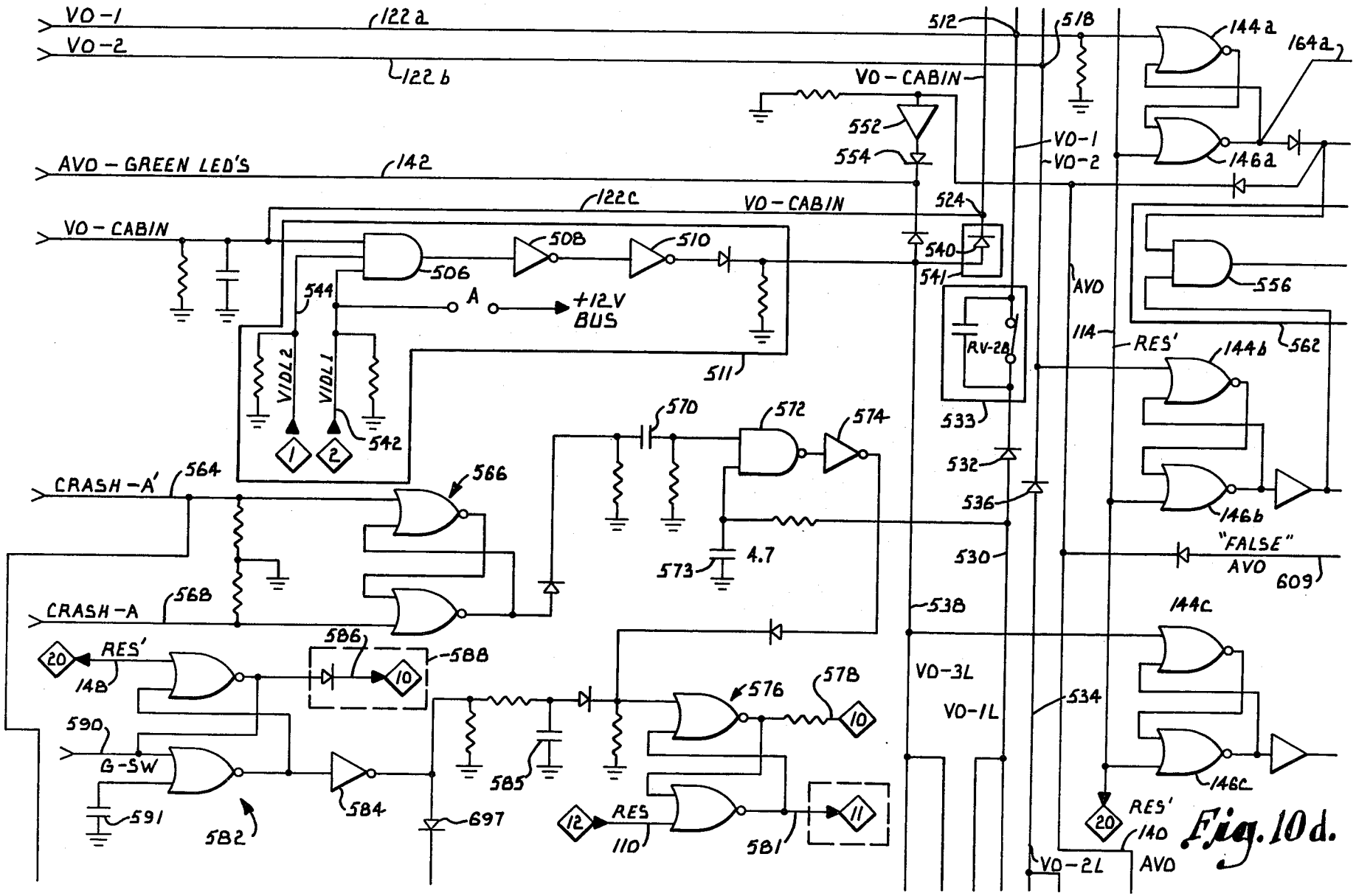

As shown in FIGS. 10*a* and 10*d*, the VO-1 line leads to a junction 512 which connects through a 4.7 mf capacitor 514 with an amplifier 516 applying its output to the RES' line 148. Similar, the VO-2 line leads to a junction 518 which connects with the RES' line 148 through a capacitor 520 and an amplifier 522. A junction 524 connected with the VO-cabin line connects with line 148 through a capacitor 526 and an amplifier 528.

When the No. 1 valve 500 is energized, a high signal is applied to a VO-1L line 530 which connects with junction 512 through a diode 532 and a normally closed relay contact RV-2B (which is omitted when two way valves are employed, as indicated by box 533). A VO-2L line 534 is energized when the No. 2 valve 504 is energized. Line 534 connects with junction 518 through a diode 536. A VO-3L line 538 which is energized when both valves 500 and 504 are deenergized connects with junction 524 through a diode 540. As indicated by box 541, diode 540 is replaced by a jumper when two way valves are used. The VO-1L, VO-2L and VO-3L lines provide holding circuits for the valve latches in substantially the same manner described previously in connection with the first embodiment of the invention.

Figure 10E:
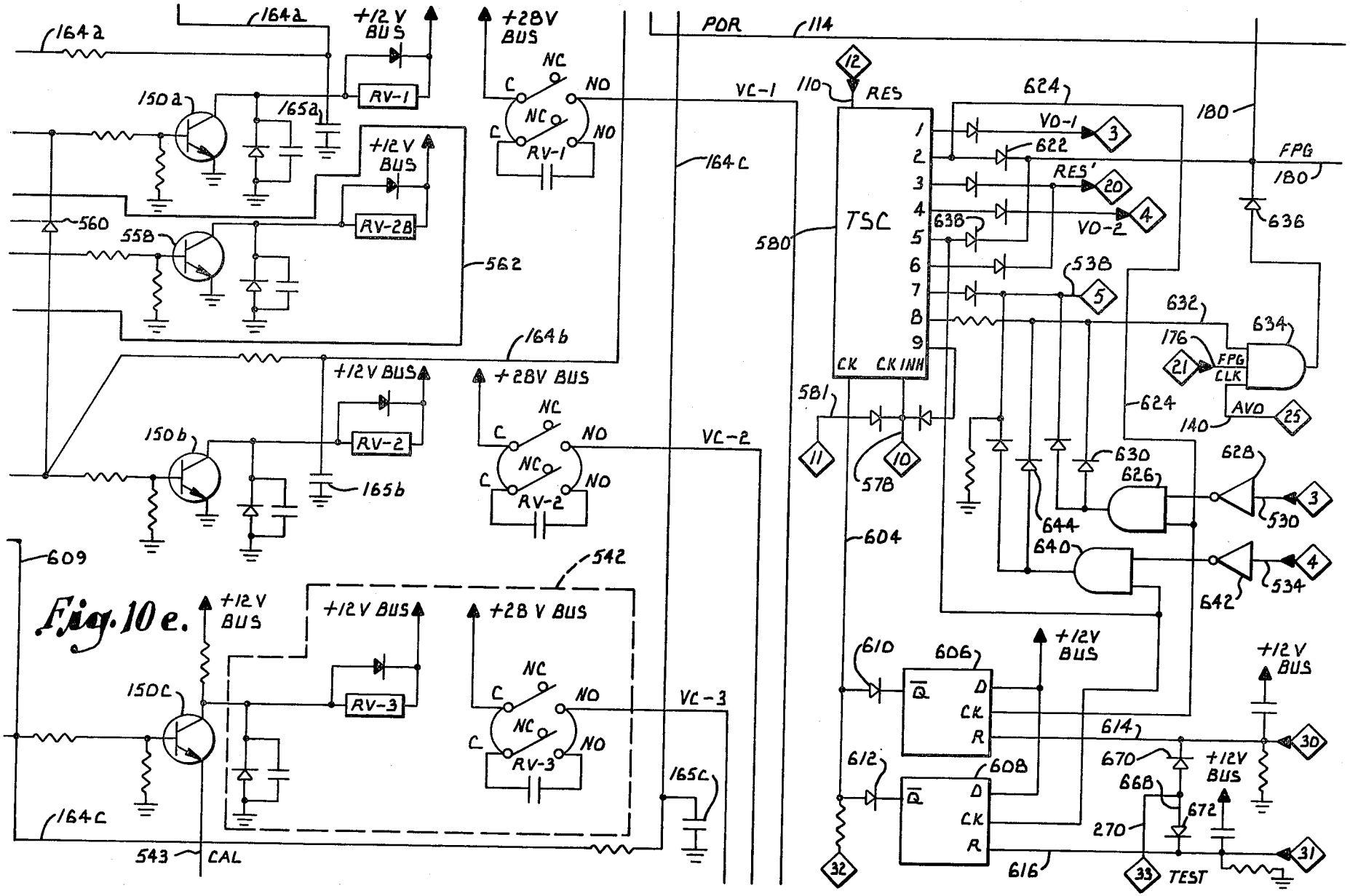

FIG. 10*e* illustrates the transistors 150*a* and 150*b* which energize the relay coils RV-1 and RV-2 having the corresponding contacts which complete the VC-1 and VC-2 lines, respectively. The VC-1 and VC-2 lines energize valves 500 and 504, respectively. The RV-3 relay and VC-3 line are not present when three way valves are used, as shown by the dashed box 542, although they are used when two way valves are employed, as will be explained more fully. The emitter of transistor 150*c* connects with the CAL (cabin light) line 543 which lights the "ARMED" half of the cabin switch when energized.

FIG. 10*b* illustrates the latch circuits formed by gates 168*a* and 170*a*, 168*b* and 170*b* and 168*c* and 170*c* that connect with the left engine LE-A and LE-A' lines 118*a* and 124*a*, the right engine RE-A and RE-A' lines 118*b* and 124*b* and the cabin CA-A and CA-A' lines 118*c* and 124*c*, respectively.

As previously described, when the corresponding push button is depressed, these latches apply pulses to gates 166*a*–166*c* through capacitors 172*a*–172*c*. The other inputs to gates 166*a*–166*c* are applied on the valve latch output lines 164*a*–164*c* which are tied to ground via the capacitors 165*a*–165*c*. Gates 166*a*–166*c* connect with respective circuits 174*a*–174*c* receiving clock inputs on line 176 from the firing pulse clock circuit 178. The output pulses from circuits 174*a*–174*c* are applied to the FPG bus 180. A three input AND gate 545 (not present if three way valves are used) connects on its output side with FPG bus 180 and on its input side with lines 140, 176 and 581.

The firing pulses which detonate the extinguishant bottles are generated somewhat differently in the FIGS. 9 and 10 system. Referring to FIG. 10*c*, the pulses applied to the FPG bus 180 are applied to the clock input of a bottle sequence counter circuit (BSC) 546 having its clock inhibit input tied to an $\overline{\text{AVO}}$ line 548. The $\overline{\text{AVO}}$ (an inverted active AVO) signal comes from the AVO (any valve open) bus 140 through an inverter 550 (FIG. 10*h*). The reset pin of circuit 546 is tied to an AND gate 551 receiving inputs from the POR line 114 and from the output line 222*a*.

Figure 10F:
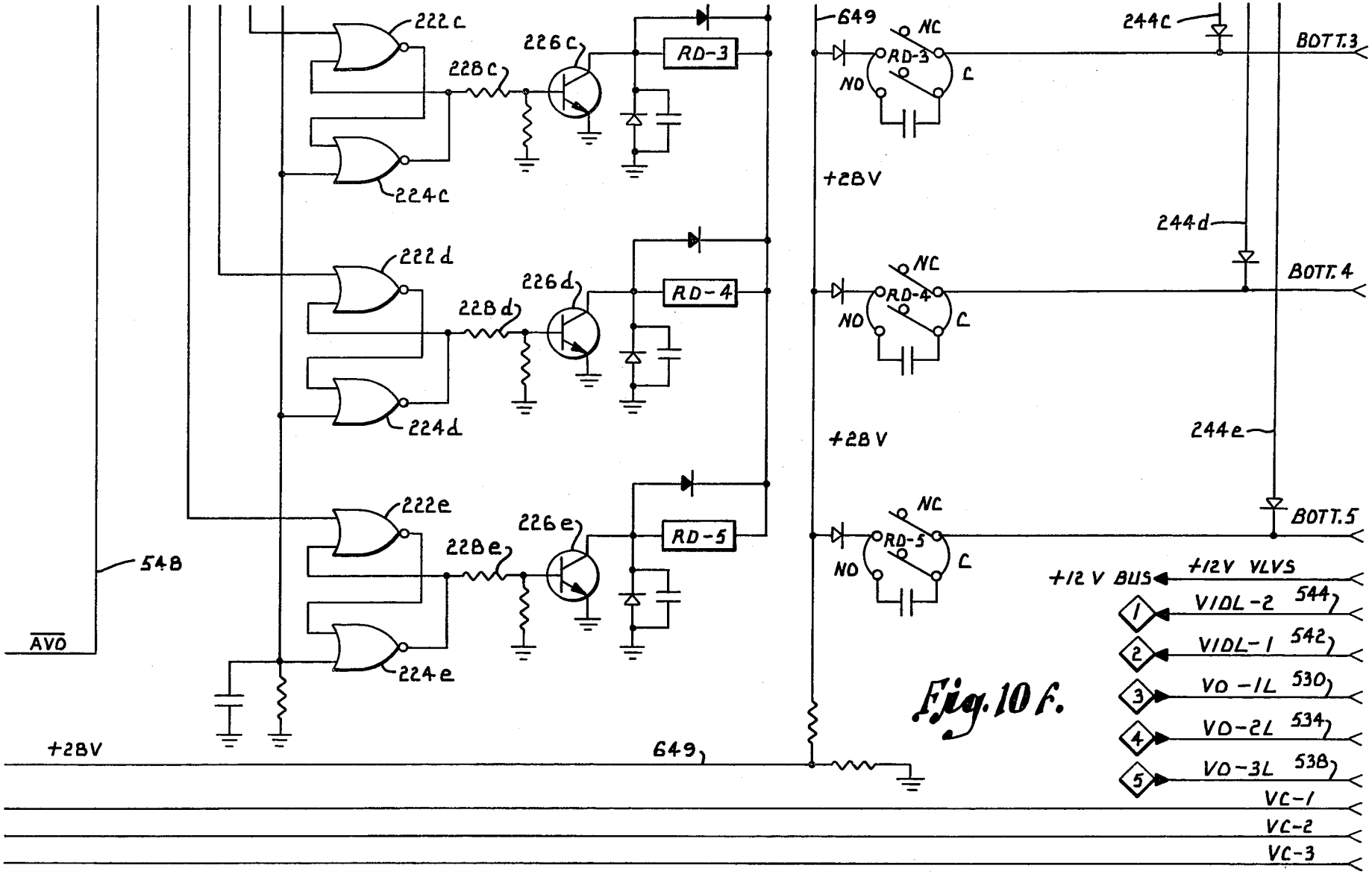

When the $\overline{\text{AVO}}$ line is low (high AVO), the bottle sequence counter 546 responds to the pulses on the FPG line 180 and applies output pulses in sequence to bottle latch circuits formed by the gate pairs 222*a* and 224*a*–222*e* and 224*e*. As shown in FIGS. 10*c* and 10*f* together, the bottle latch circuits in turn activate transistors 226*a*–226*e* to energize the detonator relay coils RD1–RD5, thus closing the associated relay contacts RD1–RD5 to apply 28 volts to the detonators of the respective bottles 19*a*–19*e* through the normally closed RT1 relay contacts, all as described previously.

Referring now to FIGS. 10*d* and 10*e*, the output line from the No. 1 valve latch circuit is applied through a diode to the AVO bus 140 which also connects through an amplifier 552 and diode 554 to the green LED gang line 142 (AVO-GREEN LEDS). The output lines from the No. 1 and No. 2 valve latch circuits connect with the input lines of an AND gate 556 having its output line tied to the base of a transistor 558. When transistor 558 is active, it energizes the RV-2B relay coil which opens the RV-2B contact in the VO-1L line 530. The output line of the No. 2 valve latch circuit is tied through a diode 560 with the output line of the No. 1 valve latch circuit. The components within the box 562 are omitted when two way valves are used in the fire protection system.

When the crash push button (not shown) is depressed, a high signal is applied to the CRASH-A' line 564 and to a latch circuit 566 formed by two NOR gates (FIG. 10*d*). The CRASH-A line 568 provides one input to the lower gate. The output from latch 566 connects through a capacitor 570 with a NAND gate 572 receiving its other input from the VO-1L line 530. The second input to gate 572 is grounded by a 4.7 mf capacitor 573. After being inverted at 574, the output from gate 572 is applied to a latch circuit 576 having another input on the reset line 110. The output from latch 576 is on line 578 which is connected to the clock inhibit input of a crash and test sequence counter circuit 580 (FIG. 10*e*). The second output from latch 576 is on line 581 which is not used if three way valves are employed in the system.

Also connected with the input of latch 576 is one output line of another latch circuit 582 having an inverter 584. A grounded capacitor 585 is connected between inverter 584 and latch 576. The other output from latch 582 is on line 586 which is not present when three way valves are used, as indicated by box 588. The inputs to latch 582 are on the RES' line and on line 590 which goes high when the gravity or impact switch (not shown) closes upon crash of the aircraft. A capacitor 591 connects line 590 to ground to assure that latch 582 will be activated only by an actual crash and not by momentary closing of the impact switch.

The CRASH-A' line 564 and the output line of inverter 584 connect with one input of a latch circuit 592 having the RES' line 148 tied to its other input. The output from latch 592 is applied through an inverter 594 to the crash switch light line 196 which lights the "ARMED" half of the crash switch as previously explained. The output from inverter 594 is also applied through respective diodes 596, 598 and 600 to the VO-1L, VO-2L and VO-3L lines 530, 534 and 538. Diodes 598 and 600 are eliminated when two way valves are used.

A test clock circuit 602 (FIG. 10*g*) applies clock pulses to a test clock line 604 which is tied to the clock input of the crash and test sequence counter 580, as shown in FIG. 10*e*. The test clock pulses are at times absorbed by a pair of flip flop circuits 606 and 608. Line 604 is connected through diodes 610 and 612 with the $\overline{Q}$ output pins of the respective circuits 606 and 608. The reset pins R of circuits 606 and 608 are connected with lines 614 and 616 which, as shown in FIG. 10*c*, are activated by transistors 618 and 620 when the respective RD1 and RD2 relay contacts close to detonate the No. 1 and No. 2 bottles.

The application of test clock pulses to circuit 580 results in sequential output pulses 1–9 therefrom. The initial pulse reaches the VO-1 line. The second pulse is applied through a diode 622 to the FPG bus 180. The second pulse is also applied to line 624 which connects with one input to an AND gate 626 and with the clock input of circuit 606. The other input to gate 626 comes from the VO-1L line 530 through an inverter 628. The output from gate 626 is applied through diode 630 to a line 632 connecting with the pin of circuit 580 on which the eighth pulse appears. Line 632 provides one input to a three input AND gate 634 having its other input pins tied to the FPG clock line 176 and the AVO line 140. The output signal from gate 634 is transmitted to the FPG bus 180 through a diode 636.

The third output pulse from circuit 580 is applied to the RES' line 148, as is the sixth pulse. The fourth pulse appears on the VO-2 line. The fifth pulse is applied through a diode 638 to the FPG bus 180 and, upstream of the diode, to an AND gate 640 and the clock input to circuit 608. The other input to gate 640 comes from the VO-2L line 534 through an inverter 642. The output from gate 640 is applied through diode 644 to line 632. The seventh pulse from circuit 580 appears on line 538, the eighth pulse appears on line 632, and the ninth and final pulse is applied to the clock inhibit pin.

Figure 10G:
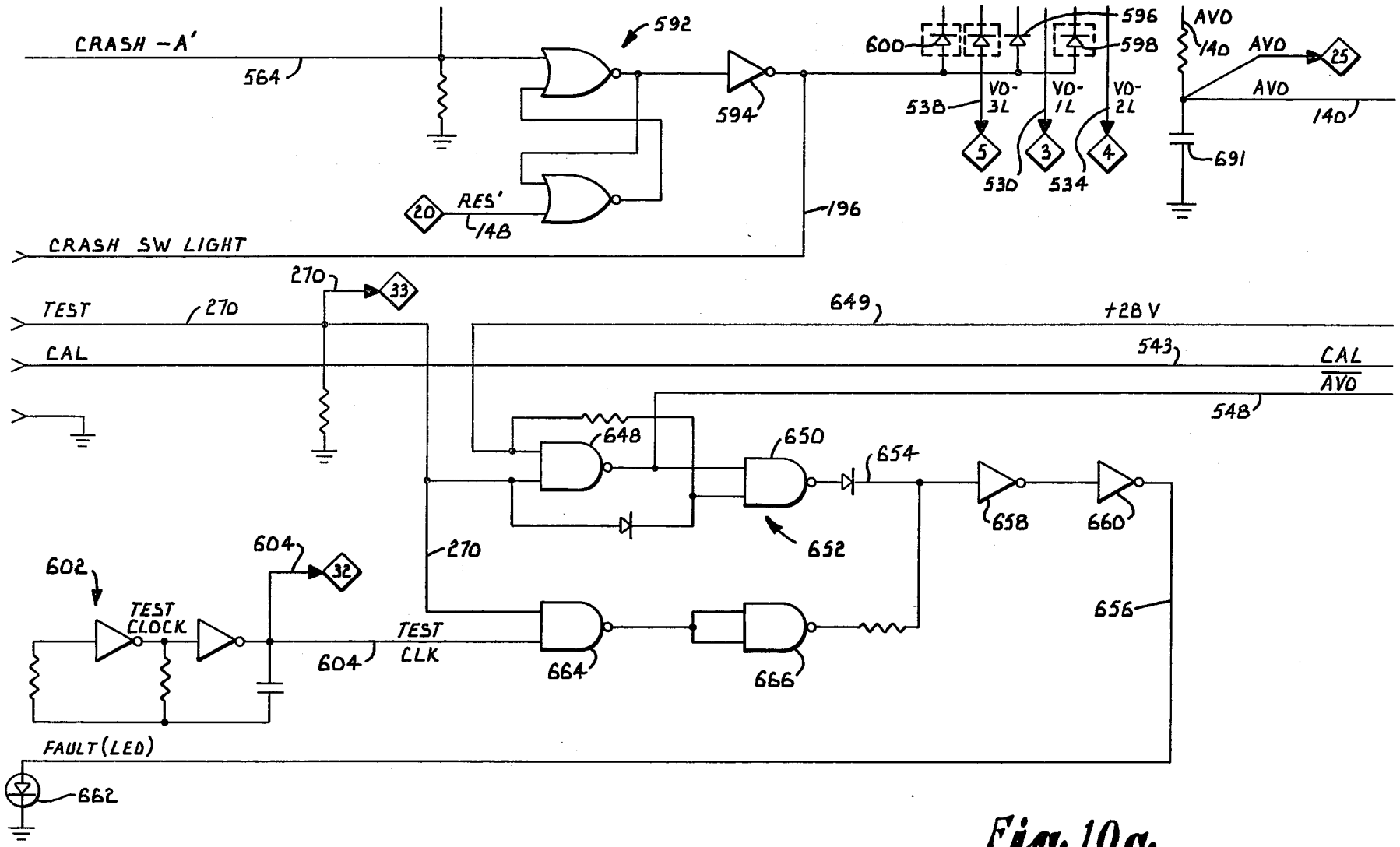

Referring now to FIG. 10*g*, the test line 270 which is energized upon activation of the test switch is connected to one input of a NAND gate 648. The second input to gate 648 comes on the 28 volt line 649 to which +28 volts is applied through the RT1 relay contacts. Gate 648 is arranged with another NAND gate 650 to provide an inclusive OR gate generally indicated at 652. The output line 654 of the inclusive OR gate 652 connects with a fault line 656 through a pair of inverters 658 and 660. The fault line connects with ground through an LED 662. A NAND gate 664 receives inputs on lines 270 and 604 and provides its output to an inverter 666 which in turn provides its output to line 654.

The test line 270 connects with a conductor 668 extending between lines 614 and 616, as shown in FIG. 10*e*. Line 668 has a pair of diodes 670 and 672 on opposite sides of its junction with line 270.

The fire protection system shown in FIGS. 9 and 10 is placed in operating condition by closing the circuit breaker (not shown) that connects the power supply with the 28 volt lines 86 and 88. The voltage regulator then provides power for the 12 volt bus 102 and applies a reset pulse on the RES line 110 through capacitor 108 and amplifier 106 and a POR pulse on line 114 through capacitor 108 and amplifier 112. Again, the RES and POR pulses that pass through capacitor 108 generate a signal on RES' line 148 (FIG. 4) which resets the valve latch circuits.

In operation of the fire protection system, a fire in any of the designated fire zones is either detected by a suitable detection system or is sensed by the pilot of the aircraft or other personnel. In the event of a fire in the left engine compartment, for example, the left engine switch is pushed once to arm the system by opening valve 500 and is pushed subsequently one or more times to discharge one or more of the extinguishant bottles in order to apply extinguishant to the left engine compartment.

Depression of the left engine switch applies +12 volts to the VO1 line 122*a* and lights the "ARMED" half of the switch in the manner indicated previously. The VO1 line connects via junction 512 with capacitor 514 and amplifier 516 to apply a pulse to the RES' line 148 which resets all valve latch circuits. The VO1 line 122*a* also applies power to the latch circuit formed by gates 144*a* and 146*a*. Although this latch circuit receives the reset pulse, the push button switch remains depressed after the reset pulse has disappeared. The high output from the No. 1 valve latch circuit is applied to the base of transistor 150*a* to make the transistor conductive. Relay coil RV1 is thereby energized, and the RV1 relay contacts connect +28 volts with the VC1 line to effect opening of the No. 1 valve 500.

When the No. 1 valve is energized, +12 volts is applied to the VO-1L line 530 which in turn connects with the VO1 line 122*a* through the normally closed relay contacts RV-2B. This completes the holding circuit which bypasses the left engine switch and thereafter maintains valve 500 open when the left engine switch is released following its initial depression. The holding circuit maintains power on the VO1 and VC1 lines until the RES' line 148 is energized to reset the latch circuit formed by gates 144*a* and 146*a*.

The high output from the No. 1 valve latch circuit is applied to the AVO bus 140 and through amplifier 552 and diode 554 to the green LED gang line 142. A current path to ground is then completed through the green LEDs and the bottle detonator circuits. If any of the extinguishant bottles has been used, its detonator bridge will be broken to break the circuit that would otherwise energize the corresponding green LED. Thus, the green LEDs that are energized on the control panel indicate which bottles are available, and the absence of a green light for a particular bottle indicates that such bottle has already been used and is unavailable, all as described previously. Again, the current passing through the detonator bridges is relatively small and is insufficient to detonate the bridges.

Depression of the left engine switch applies 12 volts to the LEA' line (designated 124*a* in FIG. 10*b*), and the signal on line 124*a* is applied to gate 170*a* to activate the associated latch circuit. A pulse is thereby applied momentarily through capacitor 172*a* to gate 166*a*. The capacitor 172a quickly becomes charged, and the high input signal to gate 166a is then removed since current no longer passes through the charged capacitor. The other input to gate 166a comes from the valve latch circuit via line 164a and is delayed until capacitor 165a (FIG. 10e) is fully charged. Due to the relatively large capacitance of capacitor 165a (4.7 micro F) compared to that of capacitor 172a (0.002 micro F) the momentary high signal applied to gate 166a through capacitor 172a is no longer present when the high signal on line 164a reaches the other input of gate 166a Consequently, there is no output generated from gate 166a upon initial depression of the left engine switch, and decade counter 174a remains inactive and does not apply a firing pulse to the FPG bus 180.

However, when the left engine switch is depressed a second time, the LEA' line 124a is once again energized and a second momentary high signal is applied to gate 166a through capacitor 172a. Since the holding circuit continuously maintains the VO1 line 122a in a high state, line 164a remains continuously high, and gate 166a receives two high inputs the second time the left engine switch is depressed. The resulting pulse applied to decade counter 174a generates an output pulse which is applied to the FPG bus 180 and to the clock input of the bottle sequence counter 546 (FIG. 10c).

At this time, the AVO bus 140 is in a high state and the $\overline{\text{AVO}}$ line 548 provides a low signal to the clock inhibit input of circuit 546. The output pulse which is applied to the bottle latch circuit formed by gates 222a and 224a activates the latch and transistor 226a, thereby making the transistor conductive and energizing relay coil RD1. The associated relay contacts RD1 then complete the 28 volt circuit through the detonator bridge of the number one bottle 19a. Extinguishant is directed from the detonated bottle through the energized valve 500 and out the deenergized port of valve 504 to the left engine compartment of the aircraft.

If one bottle of extinguishant is insufficient to control the fire, the left engine switch can be depressed repeatedly to discharge a subsequent bottle for each subsequent depression of the switch, due to the sequential pulses applied by circuit 546 to the successive bottle latch circuits. As previously described, the associated detonator bridge is destroyed each time a bottle is discharged, and the path to ground through the corresponding green LED is interrupted. Each time a bottle is discharged, the corresponding pressure switch closes due to the pressure drop in the bottle. This completes a circuit path to ground for the corresponding amber LED. Consequently, each bottle that is discharged results in energization of the associated amber LED and deenergization of the associated green LED to provide a visual indication that the bottle has been discharged and is no longer available.

It is to be understood that any or all of the fire zones can be equipped with a volume selector switch similar to the switch 72 described in connection with the first form of the invention. Also, any desired number of bottles can be discharged in either the "full cargo" or "empty cargo" setting of each volume selector switch. It should be further noted that one or more additional output lines of circuits 174a–174c can be connected with the FPG line 180 such that two or more bottles will be detonated due to the sequential pulses applied to the FPG line for each switch depression after the first.

In the event of a fire in the right engine compartment, the right engine switch is depressed to apply power to the VO2 line 122b. The path through junction 518, capacitor 520 and amplifier 522 effects a momentary pulse on the RES' line 114 to reset all valve latches. The VO2 line connects with the No. 2 valve latch formed by gates 144b and 146b to activate transistor 150b and relay RV-2, thus energizing the VC 2 line to energize the solenoid of the No. 2 valve 504. The output signal from the No. 2 valve latch circuit is also applied through diode 560 to transistor 150a (see FIG. 10e), and the No. 1 valve is thereby energized while in effect bypassing its valve latch circuit (gates 144a and 146a).

In this manner, depression of the right engine switch energizes both valves 500 and 504 to provide an extinguishant path to the right engine compartment. The energizing of valve 504 makes the VO-2L line 534 high to provide a holding circuit for the No. 2 valve latch circuit (gates 144b and 146b) after the right engine switch is released. Although the VO-1L line 530 is in a high state due to energizing of the No. 1 valve 500, the relay contact RV-2B is now open to prevent activation of the No. 1 valve latch circuit. The output signal from the No. 2 valve latch circuit is applied to the lower input of gate 556 and also to its upper input via diode 560. Transistor 558 is then made conductive by gate 556 to energize the RV-2B relay coil, thus opening the normally closed RV-2B contact in line 530.

Once both valves 500 and 504 have been energized, subsequent depressions of the right engine switch provide high signals on the REA' line (designated 124b), and circuit 174b provides firing pulses to the FPG bus 180 to detonate a bottle for each depression of the switch in the manner described earlier. The AVO line 140 goes high when the No. 2 valve latch circuit is activated and only remains high if the No. 2 valve has actually moved when energized, and the $\overline{\text{AVO}}$ line 548 is thus low to avoid inhibiting the bottle sequence counter 546. The green LED line 142 provides power to energize the green LEDS of available bottles.

If there is a fire in the cabin, the cabin switch is depressed to energize the VO-cabin line 122c. Junction 524, capacitor 526 and amplifier 528 provide a circuit path to the RES' line 148 such that a reset pulse resets all valve latch circuits. Diode 540 isolates junction 524 from the No. 3 valve latch circuit formed by gates 144c and 146c If both valves 500 and 504 are deenergized as they should be by the reset pulse, the valve idle lines 542 and 544 provide high input signals to gate 506. Since the VO-cabin line 122c remains high while the cabin switch remains depressed, gate 506 is active to activate the "No. 3" valve latch circuit (gates 144c and 146c) via amplifiers 508 and 510 and line 538.

The output signal from the No. 3 valve latch makes transistor 150c conductive to apply power to the CAL line 543 which lights the "ARMED" half of the cabin switch. Also, line 164c is energized to permit bottle detonation when the cabin switch is subsequently depressed. Line 609 provides a "false" AVO signal to the AVO line 140 even though both valves 500 and 504 are actually deenergized. The VO-3L line 538 provides a holding circuit to maintain the No. 3 valve latch circuit activated after the cabin switch has been released.

When the cabin switch is depressed again, the CA-A' line (designated 124c) goes high to detonate the first available bottle via circuit 174c and the bottle sequence counter 546 as previously described. Since both valves 500 and 504 are deenergized, the extinguishant is directed into the cabin of the aircraft through the deenergized port of valve 500. It should be pointed out that unless the AVO line 140 is energized (due to energizing of one or both of the valves 500 and 504 or due to the "false" AVO signal on line 609) the $\overline{AVO}$ line 548 will be high to inhibit circuit 546 and thereby prevent the detonation of any bottles.

When the crash switch is depressed, the crash-A' line 564 is energized to activate latch circuit 592 (see FIG. 10*g*). The low output signal from latch 592 is inverted by the inverter 594 and applied through diode 596 to the VO-1L line 530 and through diode 532 and the RV-2B relay contact to the VO1 line, thereby activating the No. 1 valve latch circuit to effect energizing of valve 500. The holding circuit provided by the VO-1L line 530 thereafter holds valve 500 open. The output from inverter 594 is also applied to line 196 to light the "ARMED" half of the crash switch.

The crash-A' line 564 also activates latch 566 (FIG. 10*d*) to apply a momentary pulse through capacitor 570 to gate 572. However, capacitor 573 delays the pulse which is applied from line 530 to the other input of gate 572, and by the time capacitor 573 is charged, the pulse applied through capacitor 570 has disappeared. Thus, gate 572 is not activated upon initial depression of the crash switch.

The second depression of the crash switch does activate gate 572 because capacitor 573 is fully charged when the second pulse from capacitor 570 reaches gate 572. Then, the high output provided by inverter 574 activates latch circuit 576, and its low output on line 578 goes to the clock inhibit input of the crash and test sequence counter circuit 580, thus permitting circuit 580 to respond to the clock pulses applied on line 604 by the test clock 602 (FIG. 10*g*). Prior to the second depression of the crash switch, line 578 is high to inhibit circuit 580.

The first pulse from circuit 580 goes to the VO-1 line which is already energized. The second pulse is applied through diode 622 to the FPG bus 180 and to the bottle sequence counter 546 (FIG. 10*c*). Circuit 546 then detonates the No. 1 bottle in the usual manner, and its contents are applied to the left engine compartment. The resultant activation of transistor 618 provides a reset pulse on line 614 to flip flop circuit 606. Delay of this reset pulse can be effected in any desired manner. Prior to thus being reset, the $\overline{Q}$ output of circuit 606 was low due to the input on its clock pin from line 624. Consequently, circuit 606 is reset to permit the clock pulses on line 604 to pass only after detonation of the bottle.

The third pulse from circuit 580 resets all valve latches, and the fourth pulse goes to the VO-2 line to energize both valves 500 and 504. The fifth pulse goes to the FPG line 180 to detonate another bottle and discharge its contents to the right engine compartment. The fifth pulse is also applied to the clock input of circuit 608, making its Q output low to prevent passage of subsequent clock pulses on line 604 until circuit 608 is reset by the delayed reset pulse that appears on line 616 due to activation of transistor 620 when the extinguishant bottle is detonated.

The seventh pulse from circuit 580 is applied to line 538 to activate the "No. 3" valve latch circuit, thus deenergizing both valves 500 and 504 and generating a "false" AVO signal on line 140. The eighth pulse goes to gate 634 which, since the AVO line 140 is high, provides output pulses under the control of the cycling FPG clock line 176. These output pulses pass through diode 636 to the FPG bus 180 and effect detonation of the remaining bottles in sequence into the cabin. The ninth and final pulse goes to the clock inhibit input to circuit 580 to terminate its cycle. It should be understood that the crash sequence can be modified to apply extinguishant in any desired quantity to the fire zones in any desired sequence.

In the event of a malfunction resulting in the failure of the No. 1 valve 500 to properly open, the signal applied to inverter 628 on the VO-1L line 530 is low since the No. 1 valve did not actually open, gate 626 then receives a high signal from inverter 628 and another high input on line 624 when the second output pulse is generated by circuit 580. Gate 626 then applies a high input through diode 630 to gate 634. The AVO line 140 is high since the No. 1 valve latch circuit is activated even though the valve did not open, and gate 634 then provides output pulses in sequence with the FPG clock line signals. The bottles are thereby detonated in sequence and are all discharged into the cabin.

If the No. 2 valve 504 should malfunction and fail to open in response to the fourth output pulse from circuit 580, the VO-2L line 534 remains low and the holding circuit it is intended to provide for the No. 2 valve latch is not completed. As a result, the No. 2 valve latch is deactivated as soon as the fourth pulse from circuit 580 passes, and the No. 1 valve is no longer held energized by the No. 2 valve latch circuit. Thus, when the fifth pulse from circuit 580 appears, both valves are deenergized. The fifth pulse provides one input to gate 640, and the other input is provided as a high signal from inverter 642 and the low VO-2L line 534.

The output from gate 640 passes through diode 644 to gate 634. The input on the AVO line 140 is high because the capacitor 691 has not yet discharged fully, and gate 634 thus provides output pulses to the FPG bus in sequence with the FPG clock line 176. Consequently, all remaining bottles are discharged into the cabin. In this manner, a malfunction in either valve 500 or 504 advances the crash system to the cabin and effects discharge of all remaining bottles into the cabin area of the aircraft.

In the event of a crash of the aircraft, the impact switch (not shown) closes to energize line 590 (FIG. 10*d*) once capacitor 591 is charged. Latch 582 is then activated and provides a low input to inverter 584 which is transmitted as a high signal through diode 697 to latch 592 (FIG. 10*g*). Activation of latch 592 provides a high signal from its inverter 594 which lights the crash switch lights via line 196 and energizes the VO-1L line 530 through diode 596. This energizes the No. 1 valve 500 via the VO1 line and the No. 1 valve latch circuit.

The high output from inverter 584 reaches latch circuit 576 only after a time delay provided by capacitor 585 sufficient to allow the No. 1 valve to open. Then, latch 576 is activated to provide a low signal on line 578 which is applied to the clock inhibit input pin of the crash and test sequence counter 580. Circuit 580 is then placed in operation to respond to the test clock pulses in the manner previously described. Again, a malfunction in either valve results in discharge of the remaining extinguishant bottles into the cabin of the aircraft.

Testing of the fire protection system is initiated by activating the test switch to energize the test line 270. As shown in FIG. 10*a*, this provides pulses on the reset line 110, the reset' line 148 and the POR line 114 to reset all valve and bottle latches. Also, line 270 energizes the RT1 test relay coil to open the RT1 contacts (FIG. 10*c*), thus removing the 28 volt power from the bottle detonator circuits to prevent actual detonation of any bottles in the test mode. Lines 244a–244e provide small amperage current to the bottle detonator circuits as indicated in connection with the first embodiment of the invention.

The test line 270 connects with line 668 between diodes 670 and 672, as shown in FIG. 10e. The test line thus resets the flip flop circuits 606 and 608 on lines 614 and 616 to make their Q outputs high. Test clock pulses on line 604 are then allowed to pass circuits 606 and 608 to the clock input of circuit 580 which provides pulses 1–9. The lights on the control panel indicate that the system is in good operating condition. The test sequence terminates with the ninth pulse which goes to the clock inhibit pin of circuit 580. As in the first embodiment, the low level current applied to the bottle detonator circuits is insufficient to cause actual detonation but does provide an indication of the ability of the system to detonate bottles in the event of a fire.

In the test mode, 28 volt power is normally removed from line 649 (FIG. 10g), and the inclusive OR gate circuit 652 receives one high input on the test line 270 and one low input on line 649, making the output line 654 low. Consequently, the test clock 602 cycles the output from gate 664 high and low, and the cycling signal is applied through inverters 658 and 660 to cause LED 662 to flash, thus indicating that the system is in the test mode. When the system is out of the test mode, line 649 is high and line 270 is low, so the inclusive OR gate 652 and NAND gate 664 both provide low outputs to the LED 662.

If a fault should occur in the test mode causing a failure to remove 28 volt power from line 649, both lines 270 and 649 are energized, and the inclusive OR gate output is a constant high which energizes LED 662 constantly. Also, the BSC 546 is inhibited, thus preventing the test sequence from continuing and thereby preventing the discharge of bottles. This inhibit signal is generated by the output of NAND gate 648 via line 548. Conversely, if there is a failure to return 28 volts to line 649 when the system is taken out of the test mode, lines 270 and 649 are both low to provide a constant high output from the inclusive OR gate 652. Again, the LED 662 is on constantly. In this fashion, LED 662 provides a visual indication in the event of fault in the system.

If two way valves are used in the fire protection system rather than three way valves, there are three valves present, one for each engine compartment and one for the cabin. The bottles connect with each valve. Activation of the No. 1 valve latch circuit opens the left engine valve, and activation of the No. 2 valve latch circuit opens only the right engine valve (No. 2 valve) since AND gate 556 and the RV-2B relay are now eliminated along with the connecting line containing diode 560. The VO-cabin line 122c connects directly with line 538 and the No. 3 valve latch circuit since diode 540 is replaced by a jumper.

The bottle detonation is accomplished in the same manner described previously, and the test system and fault indication are likewise the same. Initial depression of the crash switch activates gate 592 immediately to provide high signals to the VO-1, VO-2 and VO-cabin lines through diodes 596, 598 and 600. All three valves are then opened. The next depression of the crash switch activates latch 566 and, since capacitor 573 is now fully charged, activates gate 572 and latch 576. The high signal on line 581 activates gate 545 (FIG. 10b) which provides firing pulses to the FPG bus 180 in sequence with the pulses from the FPG clock 178. These pulses cause the bottle sequence counter circuit 546 to detonate all bottles in sequence, and the extinguishant is applied through all three open valves to the three fire zones of the aircraft. Sequence counter circuit 580 is inhibited by the high input applied on line 581 to its clock inhibit pin and is thus prevented from resetting any of the valve latches.

Energization of the impact switch line 590 activates latch 582 and, through diode 697, immediately activates latch 592 to open all valves as previously described. After a time delay sufficient to fully charge capacitor 585, latch 576 is activated to effect detonation of all bottles via gate 545, also as described previously. Again, line 581 inhibits circuit 580 to prevent it from resetting the valve latches.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A fire protection system for a vehicle such as on aircraft presenting therein a plurality of fire zones, said system comprising:

a plurality of closed containers each holding extinguishant;

a manifold connected with each container to receive extinguishant therefrom;

an extinguishant line for each fire zone, each line having one end communicating with said manifold and an opposite end communicating with the corresponding fire zone to apply extinguishant thereto;

a valve for each extinguishant line having an open position wherein the corresponding extinguishant line is open between said manifold and the corresponding fire zone and a closed position wherein the corresponding extinguishant line is closed;

means for discharging each container to apply the extinguishant therein to said manifold;

valve control means for each valve operable to move same from the closed position to the open position; and means for inhibiting said discharging means to prevent any container from being opened unless at least one valve is in the open position, whereby at least one valve is open whenever extinguishant is discharged from any container to the manifold.

2. A system as set forth in claim 1, wherein;

said valve control means includes a normally interrupted valve open circuit for each valve operable when completed to open the corresponding valve;

said discharging means includes a normally interrupted container discharge circuit for each container operable when completed to discharge the corresponding container; and said inhibiting means is operable to prevent completion of the container discharge circuit for any container unless the valve open circuit for at least one valve is completed.

3. A system as set forth in claim 2, including a switch for each valve open circuit, each switch being operable upon the initial activation thereof to complete the corresponding valve open circuit and upon subsequent activation thereof to complete at least one container discharge circuit.

4. A system as set forth in claim 3, including visual indicator means for each switch providing a visual indication when the corresponding switch has been initially activated.

5. A system as set forth in claim 2, including:

a switch for each valve open circuit, each switch being operable upon the initial activation thereof to complete the corresponding valve open circuit;

means for maintaining each valve open circuit in the completed state thereof following the initial activation of the corresponding switch; and means for completing the container discharge circuits in a preselected sequence in response to subsequent activations of each switch following the initial activation thereof.

6. A system as set forth in claim 1, including visual indicator means operable when any valve is in the open position to indicate which of the containers holds extinguishant material.

7. A system as set forth in claim 1, including:

a first light source for each container;

means for energizing each first light source when any valve is in the open position and the corresponding container holds extinguishant;

a second light source for each container contrasting with the first light source; and means for energizing each second light source when the corresponding container has discharged its extinguishant.

8. A system as set forth in claim 7, wherein said energizing means for each second light source includes:

an electric circuit for each second light source, each circuit having an activated condition wherein the corresponding second light source is energized and a deactivated condition wherein the corresponding second light source is deenergized; and a pressure sensitive switch in each circuit for sensing the extinguishant pressure in the corresponding bottle, each switch effecting the deactivated condition of the corresponding circuit when the corresponding container pressure is sufficiently high to indicate the presence of extinguishant therein and the activated condition of the corresponding circuit when the corresponding container pressure is sufficiently low to indicate the absence of extinguishant therein.

9. A system as set forth in claim 1, including means for automatically closing all open valves when said valve control means is operated to move another valve to the open position.

10. A system as set forth in claim 1, including means for opening all valves substantially simultaneously and means for discharging all containers in a preselected sequence after all valves have opened.

11. A system as set forth in claim 1, including:

a crash switch;

means for opening all valves upon the initial activation of said crash switch; and means for discharging all of said containers in a preselected sequence upon subsequent activation of said crash switch.

12. A system as set forth in claim 1, including means for opening all valves and discharging all containers in the event of a preselected occurrence such as a crash of the aircraft.

13. A fire protection system for a vehicle such as an aircraft presenting therein a plurality of fire zones, said system comprising:

a plurality of closed containers each holding extinguishant;

a manifold connected with each container to receive extinguishant therefrom;

an extinguishant line for each fire zone, each line having one end communicating with said manifold and an opposite end communicating with the corresponding fire zone to apply extinguishant thereto;

a valve for each extinguishant line having an open position opening the corresponding line and a closed position closing the corresponding line;

a normally interrupted valve open circuit for each valve operable when completed to effect movement of the corresponding valve to the open position;

a switch for each fire zone operable when activated once to effect completion of the valve open circuit for the corresponding valve;

a normally interrupted container discharge circuit for each container operable when completed to effect discharge of extinguishant from the corresponding container; and means for effecting completion of a different container discharge circuit each time each switch is activated after the initial activation thereof, whereby repeated activation of any switch effects discharge of said containers in a preselected sequence.

14. A system as set forth in claim 13, including a light source associated with each switch and means for energizing each light source when the corresponding switch has been activated once to open the corresponding valve.

15. A system as set forth in claim 13, including:

volume selector switch means for at least one fire zone, said volume selector switch means having first and second positions;

means for effecting completion of a preselected number of container circuits in a predetermined sequence each time the switch corresponding to said one fire zone is activated after the initial activation thereof with said volume selector switch means in the first position; and means for effecting completion of a different number of container circuits in a predetermined sequence each time the switch corresponding to said one fire zone is activated after the initial activation thereof with said volume selector switch means in the second position.

16. A fire protection system for an aircraft presenting therein a plurality of fire zones, said system comprising:

a plurality of closed containers each holding extinguishant;

a manifold communicating with each container to receive extinguishant therefrom;

an extinguishant line for each fire zone, each line providing communication between said manifold and the corresponding fire zone;

a valve for each extinguishant line movable between open and closed positions to respectively open and close the corresponding line;

valve control means for each valve for effecting selective opening and closing of same;

means for discharging each container to apply the extinguishant therein to said manifold;

impact sensitive crash switch means for sensing an impact indicative of a crash of the aircraft and assuming an active condition when such impact is sensed; and means for automatically opening all of the valves and thereafter effecting discharge of all of the containers one after the other in a predetermined sequence when said crash switch means assumes the active condition.

17. A system as set forth in claim 16, including means for providing a time delay between the opening of all valves and the discharge of the initial container.

18. A system as set forth in claim 16, including manually activated switch means operable to effect opening of all valves substantially simultaneously upon initial activation of the switch means and to effect discharge of the containers in said predetermined sequence upon sebsequent activations of the switch means following the initial activation thereof.

19. A fire protection system for a vehicle such as an aircraft having a plurality of fire zones therein, said system comprising:

a plurality of closed containers each holding extinguishant;

a manifold communicating with each container to receive extinguishant therefrom when the container is discharged;

an extinguishant line for each fire zone, each line providing communication between said manifold and the corresponding fire zone;

a valve for each extinguishant line, each valve having an open position and a closed position to respectively open and close the corresponding line;

a normally interrupted valve open circuit for each valve operable when completed to open the corresponding valve;

switch means for effecting completion of each valve open circuit;

a container discharge circuit for each container operable when energized at a predetermined current level to effect discharge of the corresponding container;

means for applying current to each container discharge circuit at said predetermined level;

a test circuit operable in a test mode of operation to effect completion of each valve open circuit in a preselected sequence and to apply current to each container discharge circuit in a preselected sequence at a low level below said predetermined current level to avoid discharging the containers in the test mode;

indicator means for each valve providing an indication when the corresponding valve opens in the test mode; and indicator means for each container providing an indication when current is applied to the corresponding container discharge circuit in the test mode.

20. A system as set forth in claim 19, including visual indicator means for indicating when said test circuit is in the test mode.

21. A system as set forth in claim 19, wherein said test circuit includes:

a test switch having a first position wherein the test circuit is in the test mode and a second position wherein the test circuit is out of the test mode; and means for applying said low level current to each container discharge circuit in said preselected sequence each time a different valve is opened in the test mode.

22. A system as set forth in claim 19, wherein:

said current applying means includes a first voltage source and means for connecting said first voltage source with each container discharge circuit when said test circuit is out of the test mode;

said system includes a second voltage source providing less current than said first source; and said test circuit includes means for disconnecting said first source from all container discharge circuits in the test mode and means for connecting said second voltage source with each container discharge circuit in said preselected sequence in the test mode.

23. A system as set forth in claim 22, including means for providing a fault indication if said first voltage source is not disconnected from all container discharge circuits in the test mode of said test circuit.

24. A system as set forth in claim 22, including means for providing a fault indication if said first voltage source is not connected with each container discharge circuit when said test circuit is out of the test mode.

25. A fire protection system for a vehicle such as an aircraft presenting therein a plurality of fire zones, said system comprising:

a plurality of closed containers each holding extinguishant;

valve means for each fire zone connected with the containers and operable when activated to provide a fluid path from the containers to the corresponding fire zone;

means for discharging each container to apply the extinguishant therein to the fire zone corresponding to the activated valve means;

crash switch means operable when activated to activate all of said valve means and to thereafter discharge all of the containers one after another in a predetermined sequence; and test means for activating each valve means individually in a predelected sequence and simulating discharge of the containers in a preselected sequence, said test means including crash test means for activating all of said valve means substantially simultaneously and thereafter simulating discharge of all of the containers one after another in said predetermined sequence.

26. The invention of claim 25, including means providing a time delay between activation of said valve means and discharge of the containers.

27. The invention of claim 25, wherein said test means activates said valve means and simulates discharge of the containers in an alternating pattern.

28. The invention of claim 25, wherein said crash switch means is activated manually.

29. The invention of claim 25, wherein said crash switch means is activated automatically upon crash of the vehicle.

* * * * *